US011795534B2

(12) United States Patent
Pinger

(10) Patent No.: US 11,795,534 B2
(45) Date of Patent: Oct. 24, 2023

(54) HOT-DIP GALVANIZING DEVICE AND HOT-DIP GALVANIZING METHOD

(71) Applicant: Fontaine Holdings NV, Houthalen (BE)

(72) Inventor: Thomas Pinger, Haltern am See (DE)

(73) Assignee: FONTAINE HOLDINGS NV

( * ) Notice: Subject to any disclaimer, the term of this patent is extended or adjusted under 35 U.S.C. 154(b) by 712 days.

(21) Appl. No.: 16/616,556

(22) PCT Filed: Mar. 14, 2018

(86) PCT No.: PCT/EP2018/056346
§ 371 (c)(1),
(2) Date: Nov. 25, 2019

(87) PCT Pub. No.: WO2018/215105
PCT Pub. Date: Nov. 29, 2018

(65) Prior Publication Data

US 2021/0164086 A1 Jun. 3, 2021

(30) Foreign Application Priority Data

May 23, 2017 (DE) ..... 10 2017 111 227.8
Jun. 19, 2017 (DE) ..... 10 2017 113 358.5

(51) Int. Cl.
*C23C 2/00* (2006.01)
*C23C 2/06* (2006.01)
(Continued)

(52) U.S. Cl.
CPC ..... *C23C 2/003* (2013.01); *C23C 2/06* (2013.01); *F27B 14/20* (2013.01);
(Continued)

(58) Field of Classification Search
CPC . C23C 2/003; C23C 2/06; F27B 14/20; F27D 21/0021; F27D 21/04; F27D 99/0033
(Continued)

(56) References Cited

U.S. PATENT DOCUMENTS 2,642,834 A * 6/1953 Pearson ..... C23C 2/385 118/74
4,358,953 A * 11/1982 Horiuchi ..... G01K 3/14 374/137
(Continued)

FOREIGN PATENT DOCUMENTS

DE 1220086 6/1966
DE 3622106 * 1/1988 ..... F27D 21/0021
(Continued)

*Primary Examiner* — Jessee R Roe
*Assistant Examiner* — Michael Aboagye
(74) *Attorney, Agent, or Firm* — Edward E. Sowers; Brannon Sowers & Cracraft PC

(57) ABSTRACT

The invention relates to a device for the hot-dip galvanizing of components, comprising a galvanizing tank for holding the zinc melt in a tank interior formed by a wall of the galvanizing tank, according to the invention a monitoring apparatus being provided for monitoring the wall thickness of the wall of the galvanizing tank during the galvanizing operation. The invention further relates to a corresponding method for hot-dip galvanizing.

28 Claims, 10 Drawing Sheets

(51) Int. Cl.

| | |
|---|---|
| ***F27B 14/20*** | (2006.01) |
| ***F27D 21/00*** | (2006.01) |
| ***F27D 99/00*** | (2010.01) |
| ***F27D 21/04*** | (2006.01) |
| *F23N 5/10* | (2006.01) |

(52) U.S. Cl.
CPC ..... *F27D 21/0021* (2013.01); *F27D 21/04* (2013.01); *F27D 99/0033* (2013.01); *F23N 5/102* (2013.01)

(58) Field of Classification Search
USPC ..... 118/663; 266/99; 73/597, 598, 86, 73/866.5, 865.8; 427/433, 431
See application file for complete search history.

(56) References Cited

U.S. PATENT DOCUMENTS 4,872,345 A * 10/1989 Dicks ..... G01B 17/02 73/597
5,158,366 A * 10/1992 Nagai ..... F27D 21/0014 374/185
6,490,927 B2 * 12/2002 Braunling ..... G01N 17/04 73/597
7,090,801 B2 * 8/2006 Mueller ..... G01N 27/205 266/78
9,724,697 B2 * 8/2017 Steed ..... B02C 17/1805

FOREIGN PATENT DOCUMENTS

DE 4136447 * 5/1993 ..... F27D 21/0021
NL 7209733 1/1974

* cited by examiner

HOT-DIP GALVANIZING DEVICE AND HOT-DIP GALVANIZING METHOD

CROSS-REFERENCES TO RELATED APPLICATIONS

This application is a National Stage filing of International Application PCT/EP 2018/056346, filed Mar. 14, 2018, entitled HOT-DIP GALVANIZING DEVICE AND HOT-DIP GALVANIZING METHOD, claiming priority to DE 10 2017 111 227.8, filed May 23, 2017 and DE 10 2017 113 358.5, filed Jun. 19, 2017, and incorporates all by reference herein, in their entirety.

BACKGROUND OF THE INVENTION

The present invention relates to the technical field of galvanizing iron-based and/or ferrous components, in particular steel-based and/or steel-containing components (steel components) and/or components, preferably for the automotive and/or motor vehicle industry, but also for other technical areas of application, (for example, for the construction industry, the field of general mechanical engineering, the electronics industry, etc.), by means of hot-dip galvanizing (high-temperature batch hot-dip galvanizing).

In particular, the present invention relates to a device for hot-dip galvanizing, also called high-temperature batch hot-dip galvanizing, of components having a galvanizing tank for accommodating a zinc melt in a tank interior formed by a wall of the galvanizing tank and also a method for hot-dip galvanizing of components using an above-mentioned device for hot-dip galvanizing of components.

Hot-dip galvanizing is understood in this case as a method which protects iron-based and/or ferrous or steel-based and/or steel-containing components from corrosion, in particular rust. During the hot-dip galvanizing, in this case a metallic zinc coating is applied to the surface of the ferrous and/or steel-containing component by immersion in a molten zinc melt. A resistant alloy layer predominantly made of iron and zinc forms on the surface of the component after the galvanizing and a very solidly adhering pure zinc layer is arranged above this alloy layer. Hot-dip galvanizing represents one of various galvanizing methods.

On the process side, a differentiation is made in hot-dip galvanizing between discontinuous piece galvanizing of components and continuous strip galvanizing of, for example, steel plate or wire. Both the piece galvanizing and also the strip galvanizing are normed and/or standardized methods, cf., for example, the norms DIN EN ISO 1461 for piece galvanizing or DIN EN 10143 and DIN EN 10346 for strip galvanizing. In strip galvanizing, the strip-galvanized steel is a precursor product or intermediate product semi-finished material, which is further processed after the galvanizing, in particular by forming, stamping, trimming, etc. Piece galvanizing, in contrast, uses completely manufactured and/or formed components, which are only hot-dip galvanized after the manufacturing and thus protected from corrosion.

For hot-dip galvanizing, the zinc melt has to be kept continuously in a molten state, so that solidification of the zinc melt in the hot-dip galvanizing tank is avoided. The temperature of the zinc melt is approximately in a temperature interval of 440° C. to 460° C. This temperature interval results, on the one hand, due to the melting point of zinc at 419.5° C. and also, on the other hand, from processing-technology aspects. In hot-dip galvanizing using zinc alloys, for example, zinc-aluminum melts and/or a special process control, for example, in the case of high-temperature galvanizing, the operating temperature of the zinc melt can also be above the above-mentioned temperature interval.

In all hot-dip galvanizing methods and hot-dip galvanizing plants, it is disadvantageous that the zinc melt continuously loses heat, both via emission losses and also via the zinc bath surface and via the tank walls. Furthermore, temperature variations occur due to the immersion of relatively cold material to be galvanized, for example, ferrous components, whereby local cooling of the melt is induced. To compensate for the occurring heat losses and keep the zinc melt molten in the above-mentioned temperature interval during the hot-dip galvanizing operation, so that the iron components which are immersed in the zinc melt can react with the zinc melt and accordingly a thin zinc layer forms on the component surface, the galvanizing tank has to be continuously heated. This is typically performed by indirect heating of the galvanizing tank from the outside, essentially via the burner units by means of gas burners. In addition to the burner unit, the introduction of heat into the melt by the hot-dip galvanizing tank using further alternative different energy carriers is conceivable. To compensate for heat losses, the temperature on the outer side of the wall of the galvanizing tank is greater than the target temperature of the zinc melt or the temperature of the zinc melt in the interior of the galvanizing tank. The galvanizing tank is subject to a continuous global thermal stress, which is moreover characterized by a temperature gradient over the wall thickness. In addition, the galvanizing tank is subject to a mechanical stress, which is induced by the static pressure of the zinc melt.

Galvanizing tanks are usually enclosed in special furnaces, in which the heating units are attached.

Moreover, the hot-dip galvanizing tanks are usually embodied as steel tanks and/or as tanks having special plates and/or special coatings having a thickness of at least essentially 50 mm. A material erosion of the tank wall results on the inner walls of the hot-dip galvanizing tank due to the attack or the reaction of the molten zinc with the non-inert wall material, which thus induces a reduction of the tank wall thickness. This erosion of the tank wall thickness is undesirable, but is unavoidable in the prior art, so that a successive erosion of the wall thickness results over the usage duration of the galvanizing tank. The speed of the erosion is dependent on manifold factors in this case, for example, the quantity throughput, the zinc melt temperature, the tank wall temperature, and also the frequency and amplitude of the temperature variations which are induced by the immersion of the ferrous components in the zinc melt.

To ensure the longest possible operating duration and/or service life of the tank with high throughput rates at the same time and also low acquisition and operating costs, a large wall thickness can be selected. It is to be noted in this case that the wall thickness cannot fall below a minimum wall thickness. At an excessively low wall thickness, a tank breakthrough or a tank failure can result, wherein a tank failure causes very high costs. These high costs result due to production failure, zinc losses, repair expenditure of the zinc salvage, in particular in the event of damage, and possibly a replacement investment. An excessively low wall thickness of the galvanizing tank possibly creates a local and/or global stability loss of the galvanizing tank in this case. In the event of a local stability loss of the galvanizing tank, a leak can result in running out of the molten zinc melt, whereby very high economic damages, a greatly increased operating risk, and endangerment of the work safety for the galvanizing operation result. In addition, in the event of a global stability loss, a possible strong deformation of the tank is induced, wherein a tank exchange is made much more difficult in the event of a deformation of the tank and therefore substantial delays result during the tank replacement. To avoid the above-mentioned problems, galvanizing tanks are replaced relatively early by a new tank in practice. The replacement interval results on the basis of experiential values, wherein it is assumed that the erosion of the tank wall takes place slowly and uniformly, in particular at approximately 2 to 3 mm per year.

An elevated local erosion and thus a possible local stability loss of the galvanizing tank can occur as a result of a permanent and/or temporary misalignment of a burner. An increased tank wear is accordingly usually to be attributed to improper galvanizing operation. Improper galvanizing operation cannot always be recognized and avoided by the galvanizing operator in this case, however, so that the galvanizing tank is subjected at some points to an elevated thermal and/or mechanical stress. This stress and an accelerated erosion accompanying this can be caused, inter alia, by an incorrect setting of the burner and by an incorrect arrangement of the heat introduction zone, i.e., the zone on which the burner acts.

To avoid the local and/or global stability losses of the galvanizing tank, the galvanizing tank, as already mentioned, is replaced via a corresponding risk management at established minimal wall thicknesses. During a replacement of the galvanizing tank, the tank contents—the molten zinc melt—are pumped out and a new tank is placed in the melting furnace, wherein subsequently the zinc melt, which is still kept molten in the intermediate time, is pumped back again. This replacement not only creates an operating shutdown, but rather also results in elevated costs for the new acquisition of the tank and for the complex replacement of the galvanizing tank.

The object of the present invention is to avoid or at least substantially reduce the disadvantages in the prior art.

BRIEF SUMMARY OF THE INVENTION

In particular, it is the object of the invention to provide a device for hot-dip galvanizing or a method, which avoids a tank failure, in particular as a result of a local and/or global stability loss of the galvanizing tank.

In particular, it is the object of the present invention to enable efficient and also safe use of the galvanizing tank.

To solve the above-described problem, the present invention proposes—according to a first aspect of the present invention—a device for hot-dip galvanizing as described herein; further, in particular special and/or advantageous designs of the device according to the invention are similarly provided.

Furthermore, the present invention—according to a second aspect of the present invention—relates to a method for hot-dip galvanizing and further, in particular special and/or advantageous designs of the method.

It is self-evident in the following statements that designs, embodiments, advantages, and the like which are only set forth for one aspect of the invention hereafter for the purposes of avoiding repetitions also apply accordingly, of course, with respect to the other aspects of the invention, without this having to be mentioned separately.

In all relative and/or percentage weight-related specifications mentioned hereafter, in particular relative quantity or weight specifications, it is furthermore to be noted that they are to be selected in the scope of the present invention by a person skilled in the art in such a way that they add up in total with the incorporation of all components and/or ingredients, in particular as defined hereafter, to form 100% or 100% by weight, respectively; however, this is self-evident to a person skilled in the art.

Moreover, a person skilled in the art—with respect to an application or because of the individual case—can deviate if necessary from the range specifications listed hereafter without leaving the scope of the present invention.

Moreover, all value and/or parameter specifications or the like mentioned hereafter can in principle be ascertained and/or determined using normed and/or standardized or explicitly specified determination methods or otherwise using determination or measuring methods routine to a person skilled in the art in this field.

Having said this, the present invention will be explained hereafter in detail.

DETAILED DESCRIPTION OF THE INVENTION

Figure 1:
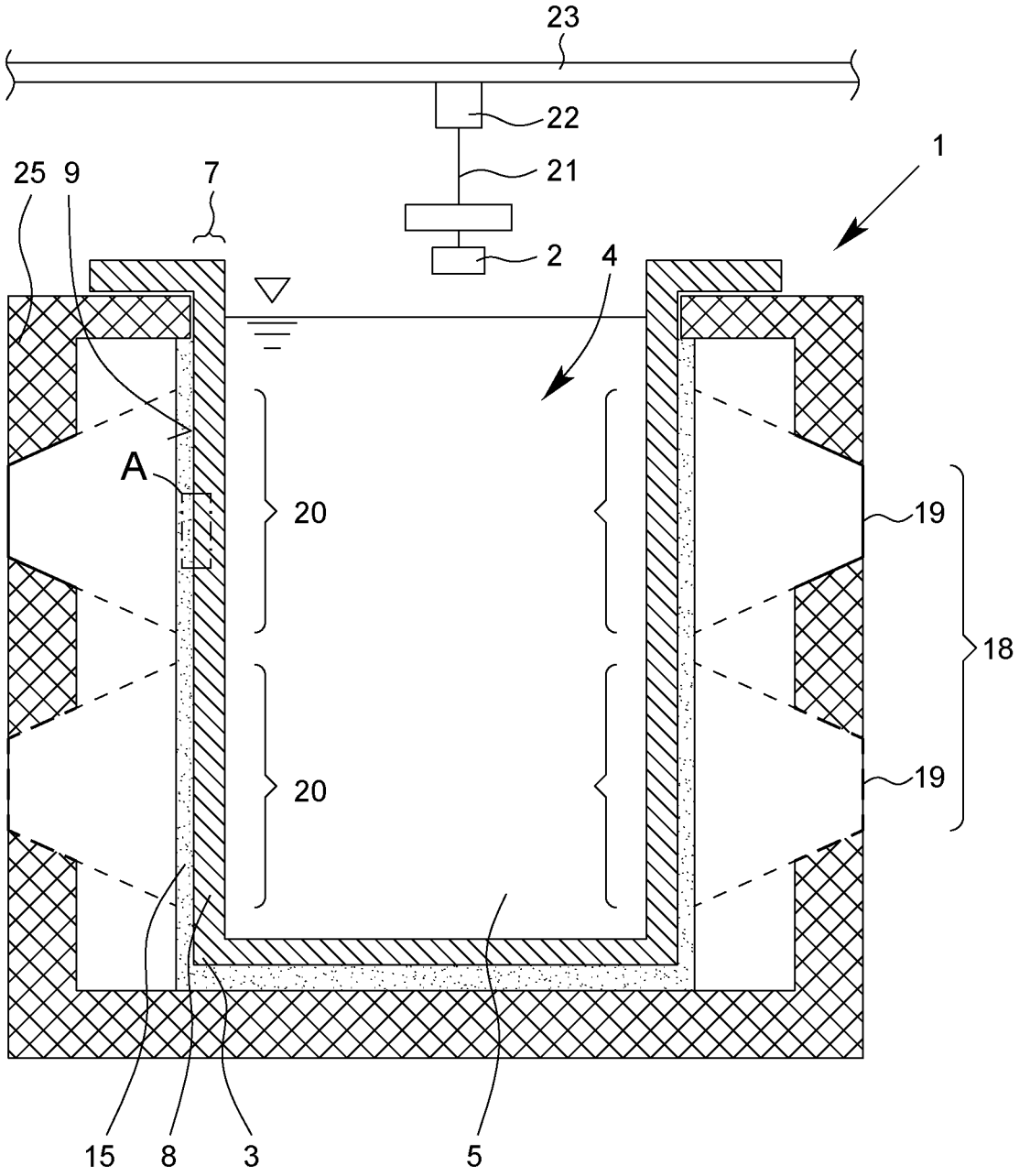
FIG. 1 shows a schematic cross-sectional view of a galvanizing tank according to the invention.

The subject matter of the present invention—according to a first aspect of the present invention—is thus a device for hot-dip galvanizing of components having a galvanizing tank for accommodating a zinc melt in a tank interior formed by a wall of the galvanizing tank, wherein according to the invention a monitoring unit is provided for monitoring the wall thickness of the wall of the galvanizing tank during the galvanizing operation.

In this context, the galvanizing operation is understood not only as the immersion of a component in a galvanizing tank, but rather also that the molten zinc melt has to be kept in a molten state, wherein heat is always introduced for this purpose, in particular continuously, into the zinc melt in the galvanizing tank via the wall of the galvanizing tank.

In conjunction with studies which have been carried out in the preliminary stages of the invention, it has firstly been established that the galvanizing tank, when it has been replaced, only reaches a critical thickness at one or at a few points, so that a majority of the tank would still be suitable for use. However, since it is not the average wall thickness, but rather the minimal wall thickness, which is decisive with regard to the work safety and/or operating safety, a replacement of the galvanizing tank has also been considered to be required in this state. It is now possible by way of the automatic monitoring according to the invention to monitor the state of the thickness of the tank wall more accurately and also to control the galvanizing process better, so that the economic disadvantages, which have previously resulted in the event of a regular replacement of a galvanizing tank, can be avoided.

Automatic monitoring of the wall thickness of the wall of the galvanizing tank offers diverse advantages according to the invention. Both global and also local stability losses of the tank can thus be avoided or at least substantially reduced, whereby both an elevation of the work safety and operational safety and also a reduction of the operating and production costs result. The galvanizing tank can be used in a targeted and purposeful manner by the monitoring unit, whereby it can always be ensured that the galvanizing tank does not reach a critical wall thickness which would require a replacement of the galvanizing tank. In particular as a result of a continuous and/or planar measurement by means of the monitoring unit of the wall thickness, elevated, in particular local erosion rates, for example, at thermally-related "hot spots" can be recognized early, so that a local stability loss of the galvanizing tank can be avoided.

By way of the invention, as a result of the continuous measurement of the tank wall thickness, reliable monitoring with pinpoint accuracy of the wall and/or the wall thickness and also individual defined or all wall regions of the tank is possible. Because of the erosions of the wall thickness thus detected, the plant safety is enhanced and thus a stronger material utilization is possible without safety loss. The minimal wall thickness to be maintained can thus be reduced, since the wall thickness of the galvanizing tank no longer has to be estimated, but rather can be purposefully measured. It is apparent in this case that the measurement and/or ascertainment of the tank wall thickness can also take place indirectly according to the invention, so that the tank wall thickness can be derived from other parameters.

A lengthened service life of the galvanizing tank results due to the monitoring unit according to the invention, since the replacement of the galvanizing tank no longer has to take place at preestablished intervals, but rather is carried out in a targeted manner in the event of need and actual requirement. Accordingly, more efficient utilization of the galvanizing tank results, in particular wherein the monitoring unit offers the option of not only recognizing local and/or global stability losses, but rather also modulating against them. An optimized, more uniform, and reduced wall erosion of the galvanizing tank results therefrom.

In addition, the monitoring unit can be retrofitted in already existing devices for galvanizing and/or in existing galvanizing tanks. The expenditure in this regard is low, in particular in consideration of the substantial advantages resulting.

In one particularly preferred embodiment of the device according to the invention, the monitoring unit comprises at least one sensor, which is provided in particular in the region of the outer side of the wall of the galvanizing tank, for measuring at least one parameter, in particular the temperature, of the galvanizing tank. In this context, for example, a detector, measuring transducer, and/or measuring feeler is considered to be a sensor, wherein the sensor can acquire both physical and also chemical properties and/or parameters as a technical component. These parameters are acquired in this case by means of a physical and/or chemical effect and subsequently converted into an electric signal, in particular for later processing.

Furthermore, the sensor is preferably coupled to an analysis unit for processing the measured value recorded by the sensor, in particular the parameter and preferably further acquired parameters, and for computing and/or deriving the wall thickness, preferably by means of the measured value and/or parameter. The wall thickness of the galvanizing tank can be concluded by way of the acquisition of the measured value by the sensor and/or the converted parameter, whereby a reaction of the galvanizing operator is enabled with regard to the wall thickness of the wall.

It is suggested according to the invention that the sensor or the sensors and also the associated measurement technology be arranged in such a way that they are subject to little wear and moreover are easily accessible, so that maintenance, inspection, and/or repair of the monitoring unit can take place in an easily accessible and simple manner. It is apparent in principle in this context that the galvanizing tank can be constructed as multilayered, wherein it can preferably also comprise an outer tank. In this case, it is suggested that the sensor or sensors be arranged between the actual galvanizing tank and the outer tank. In this case, the outer tank advantageously protects the inner tank of the galvanizing tank. Accordingly, a further protection of the sensor, which is preferably accordingly no longer facing directly toward a burner unit and/or the furnace structure, can occur due to the additional protection of the outer tank. The outer tank is additionally also advantageous in that in the event of a leak of the inner galvanizing tank, it prevents the molten zinc melt from exiting into the region of the furnace structure.

It is apparent in this context that the sensors are preferably designed in such a way that they can withstand thermal stresses at temperatures of greater than 450° C., preferably between 450° C. and 1000° C., furthermore preferably between 550° C. and 850° C., and in particular at least essentially between 550° C. and 700° C. This thermal stress of the sensor results in particular in that the sensor is preferably arranged in the region of the outer side of the wall of the galvanizing tank, so that it withstands the thermal stress as a result of a burner unit, which ensures the required heat and/or the required energy introduction in the region of the tank interior into the zinc melt. A sensor which is designed in such a way can be used purposefully for the temperature acquisition in the region of the wall of the galvanizing tank. A lengthened usage duration and/or service life of the sensor thus result, so that a frequent replacement of the sensor as a result of thermal stresses can be avoided and a reduction of the operating costs therefore results.

Furthermore, it is provided in one advantageous embodiment of the concept according to the invention that the monitoring unit is designed in such a way that a continuous measured value acquisition can be performed. A continuous measured value acquisition is understood as an acquisition of the parameters to ascertain the wall thickness of the wall of the galvanizing tank at predetermined, typically regular time intervals. The time intervals between the recorded or measured parameters are adapted in this case in particular to the existing operating situation and preferably to the component throughput. The intervals between the recordings for the measured values are preferably to be selected as at least substantially constant, whereby a continuous monitoring of the wall thickness can preferably be ensured. A measured value recording can advantageously take place every minute and/or hour.

Moreover, it is provided in one particularly preferred embodiment that at least one further sensor is provided for measuring at least one measured value of the device for hot-dip galvanizing, in particular the burner chamber and/or the tank interior and/or the zinc melt. The further sensor, in particular of similarly to the sensor of the measured value of the galvanizing tank, is preferably coupled to the analysis unit, in particular wherein the analysis unit processes the measured value recorded by the further sensor and uses it to compute and/or derive the wall thickness of the wall of the galvanizing tank, in particular while utilizing the measured value recorded by the sensor. The further sensor and/or the further sensors can record, for example, the temperature of the zinc melt and/or the temperature in the burner chamber and use them for the later computation of the wall thickness of the wall of the galvanizing tank. It is self-evident in this context that a plurality of further sensors can be provided for measuring measured values of the device for hot-dip galvanizing. With respect to the number of measurement points for the further sensors for the burner chamber temperatures and zinc melt temperatures and the accuracy of the acquisition, it can be presumed with sufficient accuracy on the basis of the air volume in the burner chamber and of the zinc melt volume in the interior of the galvanizing tank that a homogeneous temperature distribution is present in the air or in the zinc melt, respectively, and a measured value acquisition at comparatively few points, in particular at least two points and preferably less than twenty points, is sufficient.

In addition, in a further preferred embodiment, the support structure of a furnace encloses the galvanizing tank, which means that the galvanizing tank is arranged inside a galvanizing furnace. The sensor, designed in particular as a temperature sensor, is preferably arranged in the region of the boundary surface of the wall of the galvanizing tank, in particular in the region of the outer wall of the galvanizing tank. The sensor is furthermore preferably applied at least regionally to the outer side of the wall of the galvanizing tank. This arrangement enables the continuous monitoring of the wall of the galvanizing tank.

According to a further preferred embodiment variant of the device according to the invention, the sensor is designed as a thin-film thermocouple and/or as a sheath thermocouple. The sensors as already described above are preferred, and the wiring associated with the sensors is designed in such a way that it withstands high temperature stresses, in particular at temperatures in the range of 400° C. up to 700° C., and also the wall pressure of the galvanizing tank. Thin-film thermocouples in particular are suitable for these stresses, which can be applied and/or attached directly to the outer side of the wall of the galvanizing tank or in this region. Alternatively or additionally, further suitable sensors, for example, sheath thermocouples, which are designed for a high temperature stress, can also be used. The thin-film thermocouples are suitable in particular for high-accuracy temperature measurement on surfaces in demanding, versatile applications. The thin-film thermocouples are preferably designed as small, light, thin, and/or flexible in this case and have rapid response times. In addition, they are advantageously also embodied robustly. The response times of the thin-film thermocouples are preferably provided in the millisecond range. Sheath thermocouples are distinguished in particular by the easy flexibility thereof and the high resistance capability thereof against high temperature stresses. In addition, they preferably have a mechanical insensitivity and a short response time.

In addition, in one preferred embodiment of the device according to the invention, a plurality of sensors distributed over a region of the outer side of the wall of the galvanizing tank is provided. A plurality of sensors is preferably arranged in this case in the boundary surface of the wall of the galvanizing tank. In this case, the expression "boundary surface of the wall" refers, on the one hand, to the outer side of the wall itself, wherein the sensors are fastened directly on the wall. The boundary surface of the wall also means a region adjacent to the wall, in particular directly adjacent, however. In this case, the sensors then do not press directly against the wall of the galvanizing tank. They are thus located in an adjoining region. The fastening of the sensors then does not take place directly onto the wall, but rather via other means, which will be described in greater detail hereafter. The sensors preferably have a direct contact to the wall and/or press directly thereon. In this case, the sensors or the sensor can be fastened on the outer side of the wall of the galvanizing tank and/or the sensor and/or the sensors have a contact to the wall of the galvanizing tank.

A continuous measurement in conjunction with a possible planar measurement on the basis of a plurality of sensors enables thermal hot spots, in particular local stability losses, to be able to be recognized early, so that these thermal hot spots can be avoided by suitable countermeasures, wherein a uniform, in particular lesser erosion of the tank wall thickness accordingly results. In addition, a redundancy of the monitoring unit is ensured by a plurality of sensors, since even in the event of failure of one sensor, the further sensors can still ensure the continuous measured value acquisition. A redundant monitoring unit enhances the security from failure, functional reliability, and also the operational safety. Not only is a redundancy of the monitoring unit ensured by a plurality of sensors, but rather also a larger-area region of the wall of the galvanizing tank is covered.

It is preferably also the case in conjunction with the present invention that at least the regions of the galvanizing tank which are directly subjected to the burner unit are detected by sensors. In particular, it is provided that at least 20%, in particular more than 40%, and particularly preferably more than 60% of the outer side of the wall of the galvanizing tank is detected via sensors and it is obvious in this case that the above-mentioned tank surface relates to the region of the galvanizing tank which is typically filled with the molten melt. The upper region of the galvanizing tank, in which typically no melt is located, is accordingly irrelevant and is also not monitored. In practice, typically only the upper 5 to 10 cm of the galvanizing tank is usually not filled with the molten melt, so that preferably monitoring of the wall thickness of the wall of the galvanizing tank takes place over the entire region which has a contact to the molten zinc melt.

Although it is possible in principle to arrange and fasten the sensor or sensors directly on the outer side of the wall of the galvanizing process, it is provided in one preferred embodiment of the invention that the sensor and/or the plurality of sensors is arranged on a carrier plate, which extends in particular over the entire height of the galvanizing tank and/or over a defined region, in particular wherein the sensors have a direct and/or immediate contact with the outer side of the wall of the galvanizing tank by way of the carrier plate. The sensors can also preferably be incorporated into the carrier plate in this case, so that in particular a direct arrangement on the galvanizing tank wall results. The sensors are additionally protected by the carrier sheet and/or the carrier plate, since the carrier plate is arranged in particular between a burner unit comprising at least one burner and the galvanizing tank wall, in particular wherein the sensors or the sensor is/are facing toward the side of the galvanizing tank facing away from the burner unit. The temperature is thus preferably recorded by means of the sensor between the carrier sheet or the carrier plate and the wall of the galvanizing tank, in particular in the boundary surface of the wall, in particular wherein on the basis of a correlative relationship between the temperature and the wall thickness, the wall thickness of the galvanizing tank can be concluded and/or the wall thickness can be derived or computed by means of the temperature.

It is furthermore preferable to fasten the carrier plate having the sensor or the sensors on the outer side of the galvanizing tank wall in such a way that a full-surface, in particular continuous contact with the wall of the galvanizing tank is established. The carrier plate is preferably screwed onto the galvanizing tank wall in this case. If the carrier plate is screwed onto the tank wall, the tank wall has preferably been designed beforehand in such a way that welded bolts having threads can be placed thereon. In particular, low costs result with this embodiment, both for the production and also for the installation. In this case, the carrier plate comprising the sensor or the sensors does not have to assume a static supporting effect, in particular for the galvanizing tank, so that preferably the carrier sheet or the carrier plate can be embodied as relatively thin. In addition, the carrier plate can be fastened rapidly and easily on the outer side of the galvanizing tank, in particular before it is lifted into the support structure of the furnace, whereby the installation expenditure and the shutdown time of the galvanizing tank linked thereto can be minimized.

The underlying concept of the above-mentioned embodiment is that, by means of the temperature in the intermediate space between the carrier sheet and the galvanizing tank wall, in particular by means of the temperature of the boundary surface of the wall, the wall thickness of the galvanizing tank can be concluded and/or can be computed, in particular on the basis of the first Fourier equation. The first Fourier equation describes the thermal power $\dot{Q}$ transferred by heat conduction, also called thermal diffusion or conduction or thermal current. In this case, the thermal power is understood as the heat flow in a solid and/or a resting fluid as a result of a temperature influence. The heat always flows in this case—according to the second law of thermodynamics—in the direction of the lower temperature. Because of the law of preservation of energy, thermal energy cannot be lost. The heat conduction is the diffusion of thermal energy in this case, where it can be vectorially described in a temperature field T (x, y, z, τ) according to Fourier's first law as:

$$\dot{\vec{Q}} = -\lambda \cdot A \cdot \vec{\nabla} \cdot T \tag{1}$$

where:

temperature field T=T (x, y, z, τ) [T]=K thermal conductivity $\lambda = \lambda(T, p)$ $[\lambda] = \frac{W}{mK}$ -continued area element through which the heat flows $A$ $[A] = m^2$ $\rightarrow$ thermal power/thermal current $\dot{Q}$ $[\dot{Q}] = W$ Under the assumption that an isotropic material is provided, λ can be assumed to be a scalar. Written differentially, the following results:

$$\dot{Q}_i = -\lambda \cdot A \frac{\partial T}{\partial x_i} \tag{2}$$

In the non-isotropic case, the following applies in differential notation:

$$\frac{\dot{Q}_i}{A} = -\lambda_{ij} \cdot \frac{\partial T}{\partial x_j} \tag{3}$$

As a special case, in particular for simple computation of the wall thickness, a stationary thermal power, also called thermal current and/or heat flow, can be assumed, wherein T represents the time in this case.

$$\frac{d\dot{Q}}{d\tau} = 0 \qquad \dot{Q} = const. \tag{4}$$

Equation (1) may thus be simplified in the one-dimensional case using (4) to $$\dot{Q} = -\lambda \cdot A \frac{dT}{dx} = const. \tag{5}$$

By means of integration, in a first system having the thermal conductivity $\lambda_1$, wherein a flat plate has the thickness $t_1$ and the temperature $T_1$ is provided on one side and the temperature $T_2$ is provided on the other side of the flat plate, the following results:

$$\frac{\dot{Q}}{\lambda_1 A_1} \cdot \int_0^{t_1} dx = -\int_{T_1}^{T_2} dT \ \lambda_1 \neq f(T, x) \Leftrightarrow \frac{\dot{Q}}{\lambda_1 A_1} \cdot x \Big|_0^{t_1} = -T \Big|_{T_1}^{T_2} \Leftrightarrow \dot{Q} = \frac{\lambda_1 \cdot A_1 \cdot (T_1 - T_2)}{t_1} \tag{6}$$

The first system is preferably the carrier plate in this case, wherein $T_1$ temperature in the burner chamber $T_2$ temperature in the intermediate plane between carrier plate and galvanizing tank wall $t_1$ thickness of the carrier plate $A_1$ area through which the thermal power $\dot{Q}$ flows In a second system, in particular which comprises a flat plate, preferably the galvanizing wall, and which preferably adjoins the first system, it results that with a thermal conductivity $\lambda_2$ with a thickness $t_2$ of a plate that $$\frac{\dot{Q}}{\lambda_2 A_2} \cdot \int_{t_1}^{t_2+t_1} dx = -\int_{T_3}^{T_4} dT\ \lambda_2 \neq f(T, x) \Leftrightarrow \dot{Q} = \lambda_2 \cdot A_2 \cdot \frac{T_3 - T_4}{t_2} \tag{7}$$

wherein the following applies:

$T_3$ temperature in the intermediate plane between carrier plate and galvanizing tank wall $T_4$ temperature at the inner wall of the galvanizing tank $t_2$ thickness of the galvanizing tank $A_2$ area through which the thermal power $\dot{Q}$ flows It may be derived therefrom that $$T_3 = T_2$$

$$A_1 = A_2 \tag{8}$$

wherein this is based on the assumption that the measured value acquisition acts on the same area region. Furthermore, the assumption can be made that if the same material is used for the carrier plate as for the galvanizing tank wall, the thermal conductivities are to be equated.

$$\lambda_1 = \lambda_2 \tag{9}$$

The following relationship may thus be derived to determine the wall thickness of the galvanizing tank (where $\lambda_1 = \lambda$ and $A_1 = A$):

$$\dot{Q} = \frac{\lambda}{t_1} A(T_1 - T_2) \tag{4}$$

$$\dot{Q} = \frac{\lambda}{t_2} A(T_2 - T_4)$$

where $\dot{Q} = const.$ $$\Rightarrow \frac{\lambda}{t_1} A(T_1 - T_2) = \frac{\lambda}{t_2} A(T_2 - T_4) \Leftrightarrow t_2 = t_1 \cdot \frac{T_2 - T_4}{T_1 - T_2} \tag{10}$$

The computation is to be carried out using the corresponding, in particular known coefficients of heat transfer and/or thermal conductivities $\lambda_1$, $\lambda_2$ of the materials used only if different materials are used.

The temperature $T_4$ (temperature at the inner wall of the galvanizing tank) and the temperature $T_1$ (temperature in the burner chamber) are preferably acquired by the further sensor. If the monitoring unit is used in an existing hot-dip galvanizing tank, wherein the device for hot-dip galvanizing already comprises sensors for measuring the temperature in the burner chamber and in the zinc melt, the measured values of these already provided sensors can thus advantageously be used. In principle, it is also conceivable if no measured values on the temperature in the burner chamber and/or on the temperature in the zinc melt are provided, to estimate them, in particular by way of further measured values.

In a further preferred embodiment of the device according to the invention, it is provided that at least one sensor is provided on an additional wall section, which in particular extends over the entire height and/or length of the galvanizing tank. The galvanizing tank can in principle be embodied as multilayered in this case, in particular wherein it provides an external outer tank enclosing the inner part of the galvanizing tank. The additional wall or the wall section can preferably assume a supporting function for the galvanizing tank, so that this tank is relieved. It is advantageous that in comparison to a full tank which fully encloses the galvanizing tank, a material-saving construction is enabled with simultaneous relief of the galvanizing tank, so that solely regions are covered at which the burners are also arranged and/or the heat introduction zones are provided. In particular, the lateral surfaces, in particular the burner-free regions, preferably the bottom and in particular the end faces, cannot therefore be arranged on an additional wall section which preferably extends over the entire height and width of the associated galvanizing tank wall. The gap between the wall section and the galvanizing tank wall, which is provided in particular as a result of production, is preferably closed as a result of the hydrostatic pressure of the galvanizing tank, which is transferred in particular to the outer wall. The acquisition of the wall thickness is performed in particular similarly to the above-described measuring method in the case of the carrier plate, since the sensor records the temperature on the wall of the galvanizing tank which is aligned with the wall section.

In addition, it is provided in a further advantageous embodiment variant of the concept according to the invention that the sensor and/or the sensors are provided in the intermediate space, in particular in the boundary surface of the wall, on the exterior at least regionally on an outer tank enclosing the galvanizing tank. In this case, the at least one sensor records the temperature of the boundary surface in the intermediate space between the wall of the galvanizing tank and the outer tank, which can be approximately equated to the temperature of the outer wall of the galvanizing tank, so that an ascertainment of the wall thickness can be performed on the basis of the one-dimensional, planar heat equation (Fourier's first law). The outer tank is advantageous above all with regard to the operational safety, since it prevents the zinc melt from running out in the event of possible damage to the galvanizing tank and/or a leak of the galvanizing tank.

In addition, the wall thickness of the galvanizing tank can preferably be reduced because of the outer tank, in particular from 50 mm to 30 mm, wherein the tank service life does not have to be decreased. In this case of the reduction of the wall thickness of the galvanizing tank, a reduced transportation and lifting weight results, so that the logistical expenditure during the replacement of a galvanizing tank can be significantly reduced. The outer tank preferably assumes a part of the support function with regard to absorbing the stress as a result of the hydrostatic pressure of the zinc melt from the galvanizing tank, so that the tension state in the galvanizing tank material can preferably be substantially reduced. A corrosion as a result of tensions, also called tension corrosion, can be substantially reduced in this way. This results in particular in a reduction of the overall erosion of the tank wall thickness.

The galvanizing tank is preferably introduced into the outer tank in this case, so that a gap results between the unfilled galvanizing tank and the outer tank. The gap is typically required with regard to the installation capability and to compensate for manufacturing tolerances. As a result of the filling of the galvanizing tank with the zinc melt in the tank interior, the gap closes because of the hydrostatic pressure which is induced as a result of the zinc melt, so that preferably both tanks come into direct contact with one another. If the sensor or the sensors are provided in this case on the inner side of the outer tank, which faces toward the galvanizing tank, a preferably nearly exact recording of the applied temperature at the galvanizing tank wall thus preferably results, advantageously without the influence of interfering influences and/or false signals. In addition, a full-surface contact of the tank walls generates an optimum heat transfer as a result of the heat conduction from the outer tank to the galvanizing tank, wherein the outer side of the outer tank faces toward the burner unit. In this embodiment, the at least one sensor is protected by the outer tank wall from the high thermal stresses of the burner unit.

Moreover, it is particularly advantageous if the outer tank and/or the wall section and/or the carrier plate have an increased strength in comparison to the galvanizing tank. In this context, embodying the above-mentioned components from a steel of the type 5355 is suggested in particular. 5355 steels are used in particular for highly-stressed parts in machinery and steel construction. The 5355 steel preferably has an enhanced strength as the material of the galvanizing tank, in particular wherein the galvanizing tank is preferably produced from VZH steel. VZH steel is preferably used for galvanizing ladles and lead smelting ladles and also for similar intended uses. In this case, VZH is a soft special steel which is smelted without silicon added. The deoxidizing is performed using aluminum, wherein the aluminum content is adapted to the nitrogen content. In particular, the standard embodiment of a VZH galvanizing tank has a strength at a temperature of 450° C. of less than 55 MPa. The minimum yield strength, in particular for plate thicknesses between 35 to 70 mm, is approximately 175 MPa in the case of a VZH steel at room temperature. In contrast thereto, the minimum yield strength at room temperature in the case of an 5355 steel is 355 MPA, in particular wherein the strength at a temperature of approximately 450° C. is 250 MPa. Accordingly, the strength in the provided temperature interval of the hot-dip galvanizing in the case of an 5355 steel is preferably five times higher than in the case of a VZH steel, so that in particular the resulting required cross section of the tank plate for absorbing the same stress can be substantially less.

The sensor is advantageously regionally arranged on the outer side of the wall of the galvanizing tank and/or presses against the outer side of the wall of the galvanizing tank. In the case of a direct contact with the outer wall of the galvanizing tank, the wall layer thickness of the galvanizing tank can in particular be ascertained directly, without the use of a further wall, via the temperature of the outer side of the galvanizing tank. A one-dimensional, stationary thermal equation of a planar wall is used for this purpose. In the one-dimensional stationary thermal equation, the temperature is only a function of the x coordinate and the heat is exclusively transferred in this direction. For example, a wall of the thickness $t_2$ separates a hot fluid, in particular a molten zinc melt, from an outer region, as in the case of the galvanizing tank. The wall temperatures at the hot and at the cold side are denoted by $T_3$ or $T_4$, respectively.

The following equation can be applied by way of a suitable form of the thermal equation with regard to the one-dimensional stationary heat conduction without energy generation in the wall:

$$\dot{Q} = -\lambda \cdot A \frac{dT}{dx}$$

At a known thermal power, the wall thickness can thus be concluded.

If the computation of the wall thickness is to be performed without the use of the thermal power, in particular a further wall is thus to be preserved to determine the wall thickness by means of the temperature, for example, in the form of a carrier plate and/or a wall section and/or an outer tank. It is apparent in this context that the measurement of the temperature by means of at least one sensor can also be performed directly on the outer side of the wall of the galvanizing tank with the use of a carrier plate and/or a further wall section and/or an outer tank.

In addition, it is particularly advantageous if the monitoring unit comprises at least one storage unit for storing the measured and/or computed and/or derived values. The storage unit can be designed in particular in such a way that the operating states are recorded, so that a verification of specific sequences in the galvanizing operation can be ensured. Accordingly, this storage is also advantageous in particular if a fault has occurred which is to be evaluated later. In addition, the time curve of the tank wall thickness can be observed and/or taken into consideration by way of a storage unit, so that not only an immediate reaction to parameters can take place, but rather it is also possible to react to a creeping curve and/or change of the parameters. A storage unit therefore offers the option of permanently optimizing the galvanizing process and making it more efficient.

The monitoring unit preferably comprises a display unit for optical and/or acoustic display, in particular wherein the display unit is coupled to the analysis unit in such a way that if the wall thickness falls below a predetermined limiting value of the wall thickness of the wall of the galvanizing tank, a notification signal is displayed. It is also apparent in this context that the display unit can be coupled to the storage unit, so that a display of a time curve of the parameters is also enabled. It is thus possible in particular for the operating personnel of the galvanizing to reconstruct the chronological change of the wall thickness of the galvanizing tank, so that a more efficient use of the galvanizing tank results.

In particular a wall thickness in the range of 5 to 30 mm, preferably between 10 and 25 mm, furthermore preferably between 15 and 20 mm, in particular at least essentially 20 mm is to be considered to be the limiting value of the wall thickness of the wall of the galvanizing tank. A wall thickness of 20 mm has already reached a critical state of the galvanizing tank and a possible global and/or local stability loss of the galvanizing tank cannot be precluded, so that issuing a notification is particularly advantageous upon reaching the critical wall thickness or the limiting value of the wall thickness.

The monitoring unit is advantageously coupled to a burner unit comprising at least one burner, wherein the monitoring unit is designed to control the burner unit. The burner unit introduces the required thermal energy into the zinc melt via the galvanizing tank wall. It is finally apparent that preferably the burner unit comprises a plurality of burners, which are preferably distributed around the circumference and/or the height of the galvanizing tank, and secondly are in particular distributed spaced apart uniformly, aligned on its outer wall, wherein a heat introduction zone is formed on the galvanizing tank wall by the burners. Heat introduction zone refers in this case to the region of the outer wall of the galvanizing tank which is engaged directly by the flame of the burner or the flame cone of the burner. As a result of the invention, it is now possible to form the heat introduction zone so that individual, in particular local elevated temperature regions, so-called "hot spots", are avoided. For this purpose, the individual burners of the burner units can be modulated via the control unit with respect to the burner power and/or the alignment thereof. In particular, the burner unit is to be controlled and/or aligned so that an at least essentially uniform heat introduction zone results on the outer wall of the galvanizing tank.

The control unit of the burner unit is preferably to be embodied so that a uniform erosion of the tank wall thickness results. In particular, a minimal erosion of the tank wall is to be ensured. If the parameters deviate from predetermined target values, for example, the combustion power of a burner can be changed. In addition, it is also conceivable to change the combustion cone of a burner, in particular wherein the direction of the burner is changed. Thus, for example, the heat introduction zones can be set. In the case of a plurality of burners, an individual setting is preferably provided for each burner. Upon reaching a maximum and/or minimum limiting value of a parameter, for example, 20 mm as the wall thickness of the wall, an immediate shutdown of the burner unit can also be initiated. The burner unit can therefore be set as a function of the acquired measured values and in particular as a function of the time curve of parameters, so that an increase of the material efficiency and a longer service life of the galvanizing tank results.

The control of the burner unit is advantageously formed via the gas supply and/or the air supply of the burner of the burner unit. The gas supply and/or the air supply can thus be adapted in such a way that an increased or a reduced thermal power of the burner results.

In addition, it is provided in a further embodiment variant of the concept of the invention that the burner unit comprises at least two independently controllable burners. Two burners independent of one another offer the advantage that different heat introduction zones are possible on the galvanizing tank or the wall of the galvanizing tank if this is required because of the galvanizing process and the components introduced into the galvanizing bath.

The heat introduction zones are advantageously arranged spaced apart in relation to one another on the outer side of the galvanizing tank, so that uniform heating and/or a constant temperature of the zinc melt is ensured.

In addition, it is provided in a further particularly preferred embodiment of the device according to the invention that the sensor and/or the sensors are arranged in the region of a heat introduction zone of the burner unit. This arrangement of the sensor or the sensors is advantageous because possible "hot spots" can predominantly occur in the regions of the heat introduction zone. It can be ensured by the arrangement of at least one sensor in at least one heat introduction zone that these zones, which are subject in particular to an elevated risk of an intensified tank wall erosion, can be continuously monitored, so that a breakthrough of the tank wall in the region of a heat introduction zone can be avoided or bypassed.

In one preferred embodiment, it is provided that the burner of the burner unit is provided in the region of a furnace support structure enclosing the galvanizing tank with spacing. In this case, the burners are or the burner of the burner unit is oriented onto the outer side of the galvanizing tank. In the case of a plurality of burners, they are distributed around the circumference of the outer side of the galvanizing tank, wherein it is suggested that the burners be spaced apart from one another at an equal distance. Additionally or alternatively, it can be provided that adjacent burners are arranged offset in relation to one another with respect to the tank height and thus heat regions of the galvanizing tank of different heights with respect to the tank height Such an arrangement is suggested in particular in the case of flat flame burners.

If high-speed burners are used, which are positioned frontally in particular and fire in the burner chamber parallel to the longitudinal wall of the galvanizing tank, a planar arrangement of the sensors is advantageously provided.

In the case of flat flame burners, the flame is applied around the burner outlet to the furnace wall, in particular because of the geometry and the flow speed, so that the flame extends in a ring shape around the burner outlet Proceeding from the burner outlet, the heat or the energy is introduced uniformly into the burner chamber. Flat flame burners are distinguished both by a high flame stability and also by the possible change of cold or heated burner air.

High-speed burners are distinguished by a high flame exit speed of the hot gas and accordingly ensure effective mixing of the furnace atmosphere and/or the burner chamber atmosphere. Furthermore, these burners are distinguished by a stable combustion behavior, also in the substoichiometric and/or superstoichiometric range.

In particular in the case of flat flame burners, in general an elevated erosion results in the region of the heat introduction region or the heat introduction zone of the burner. In the case of high-speed burners, in contrast, an elevated erosion of the wall of the galvanizing tank can result in the region along the flame. In one particularly preferred embodiment, the carrier plate is therefore only installed in the regions on which the burner acts. The sensor or the sensors are preferably arranged in the regions of elevated erosion of the wall of the galvanizing tank, so that a local and/or global stability loss can be avoided.

Further subject matter of the present invention—according to a second aspect of the present invention—is a method for hot-dip galvanizing components, in particular a method using an above-described device according to the invention, in a zinc melt, wherein the zinc melt is located and/or arranged in a tank interior formed by a wall of a galvanizing tank, it is provided according to the invention that the wall thickness of the wall of a galvanizing tank is monitored by means of a monitoring unit during the galvanizing operation.

The monitoring of the hot-dip galvanizing device offers the advantage—as already stated above—that an elevated tank wall erosion can be recognized early and/or corrective measures can be taken, and/or the tank wall erosion is minimized and continuously acquired. Accordingly, in particular the tank service life can be lengthened and/or the tank wall minimal thickness can be reduced. It is possible by monitoring the wall thickness of the galvanizing tank to avoid a breakthrough of the galvanizing tank, which is induced in particular as a result of thermal "hot spots". The operational safety is thus enhanced and in addition the production and/or maintenance costs of the galvanizing tank are reduced. For further advantages which result in conjunction with the method according to the invention, reference is expressly made to the above statements in conjunction with the hot-dip galvanizing device according to the invention.

In one particularly preferred method embodiment, it is provided that at least one sensor, which is provided in particular in the region of the outer side of the wall of the galvanizing tank, measures at least one parameter, in particular the temperature, of the galvanizing tank and an analysis unit coupled to the sensor processes the recorded measured value, preferably with further acquired parameters, and computes and/or derives the wall thickness of the wall of the galvanizing tank therefrom. The monitoring of the wall of the galvanizing tank can be performed by the, in particular indirect, measurement and/or determination of the wall thickness by means of the sensor. It is apparent in this case that a plurality of sensors creates a redundancy of the monitoring unit and in this regard it is advantageous if a plurality of sensors is used, in particular in the region of a heat introduction zone. The wall thickness can be determined by the recorded measured value and/or the ascertained parameter, so that an analysis unit can ascertain the desired wall thickness.

A further sensor preferably measures further measured values of the device for hot-dip galvanizing, in particular the temperature of the zinc melt and/or the temperature in the burner chamber. The further sensor advantageously transfers the measured value to the analysis unit to ascertain the wall thickness of the wall of the galvanizing tank.

A continuous measured value acquisition is preferably performed by means of at least one sensor. The continuous measured value acquisition is in particular to be executed in such a way that a measured value acquisition of at least one parameter, in particular to determine the wall thickness of the wall, is carried out at regular intervals. The continuous measured value acquisition offers the advantage that the wall thickness of the galvanizing tank can be monitored during the entire galvanizing operation, so that it is possible to react individually to extraordinary operating situations and/or malfunctions.

In a further preferred embodiment of the method, it is provided that at least one storage unit of the monitoring unit stores the values, which are computed and/or derived in particular. A storage of the values, in particular the wall thickness, enables the chronological change of the value to be reconstructed, in order to derive or recognize possible deviations from the target value or target curve. In this case, the monitoring unit can thus be designed in such a way that not only limiting values of the wall thickness of the galvanizing tank are monitored, but rather also an elevated tank wall erosion over a defined time frame. In this way, possible faults during the galvanizing time frame can be recognized. In any case, it is possible that the tank wall erosion is reconstructed by way of the storage unit and a functional relationship is established between the tank wall thickness of the galvanizing tank, the galvanizing procedure, and/or the time.

It is particularly preferable for a display unit of the monitoring unit to display an optical and/or acoustic notification signal. This notification signal is preferably displayed when the wall thickness falls below a predetermined limiting value of the wall thickness of the wall of the galvanizing tank. In this case, the display unit is advantageously coupled to the analysis unit, so that it is possible to recognize falling below a predetermined limiting value. The limiting value of the wall thickness of the wall of the galvanizing tank is preferably approximately 20 to 25 mm and/or is in a range from 5 to 30 mm, preferably 10 to 25 mm. An optical and/or acoustic signal enables a manual intervention of the operator of the galvanizing tank to be enabled in addition to a possible, preferably automated control of the burner unit, so that the operator is made aware of a malfunction situation. The operator can, for example, initiate an immediate shutdown of the burner unit and/or is sensitized to the fact that special attention has to be paid to specific regions of the galvanizing tank. The monitoring unit is preferably coupled to a burner unit comprising at least one burner, wherein the monitoring unit controls the burner unit A control of the burner unit via the monitoring unit ensures that the burner unit can influence the heat introduction zones on the wall in dependence on the wall thickness of the wall of the galvanizing tank. An increase or decrease in size of a heat introduction zone is thus possible at equal, increased, or reduced thermal power. In addition, in particular in the case of an automated procedure, thermal hot spots can be avoided on the wall of the galvanizing tank or on the outer side, which faces toward the burners. A control of the burner unit by means of the monitoring unit enables the coupling of the burner unit to the analysis unit and/or the storage unit. It is ensured by the coupling of the burner unit to the analysis unit acquiring the measurement data that in particular an optimum heat introduction can take place into the zinc melt, and preferably a uniform erosion of the wall thickness of the galvanizing tank takes place.

In addition, it is particularly advantageous if the monitoring unit controls the gas supply and/or the air supply of the burner of the burner unit in such a way that the burner power can be produced based on the computed and/or derived wall thickness of the wall of the galvanizing tank. The monitoring unit can finally not only control the gas supply and/or the air supply of the burner, but rather in particular also the alignment of the burner, preferably the combustion cone, or, in particular in the case of a plurality of burners, can modulate individual burners and/or operate or even shut down the burners separately.

As a result, the invention relates to a device for hot-dip galvanizing of components having a galvanizing tank for accommodating a zinc melt in the tank interior, wherein a monitoring unit is provided for monitoring the wall thickness of the wall of the galvanizing tank during the galvanizing tank operation. In addition, a method is provided according to the invention using the above-mentioned device for hot-dip galvanizing of components. The wall thickness of the wall of the galvanizing tank can in particular be computed and/or derived from at least one measured value or parameter which is measured or derived by the monitoring unit.

Further features, advantages, and possible applications of the present invention result from the following description of exemplary embodiments on the basis of the drawing and the drawing itself. In this case, all features which are described and/or illustrated in the figures form the subject matter of the present invention as such or in any arbitrary combination, independently of the combination thereof in the claims or the reference thereof.

Figure 2A:
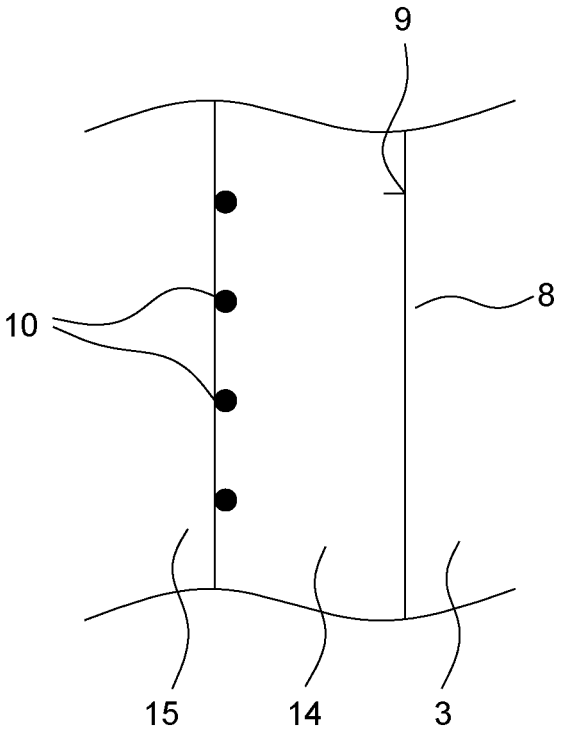
FIG. 2A shows a schematic cross-sectional view of an alternative of detail A from FIG. 1.
Figure 2B:
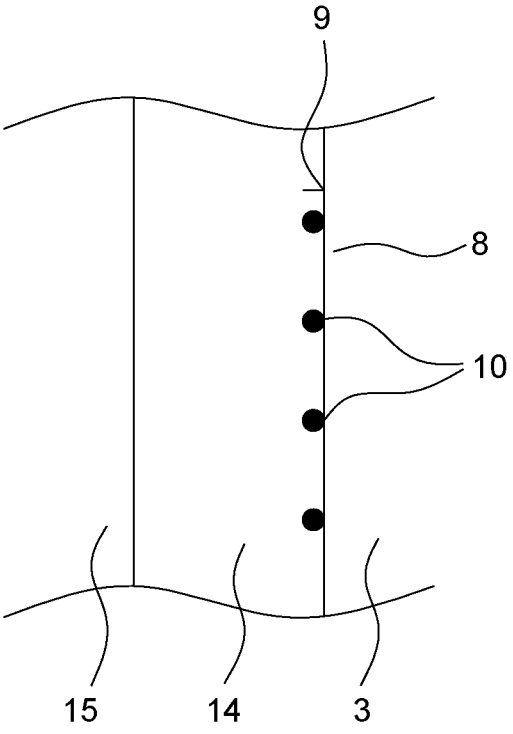
FIG. 2B shows a schematic cross-sectional view of another embodiment of detail A from FIG. 1.
Figure 3:
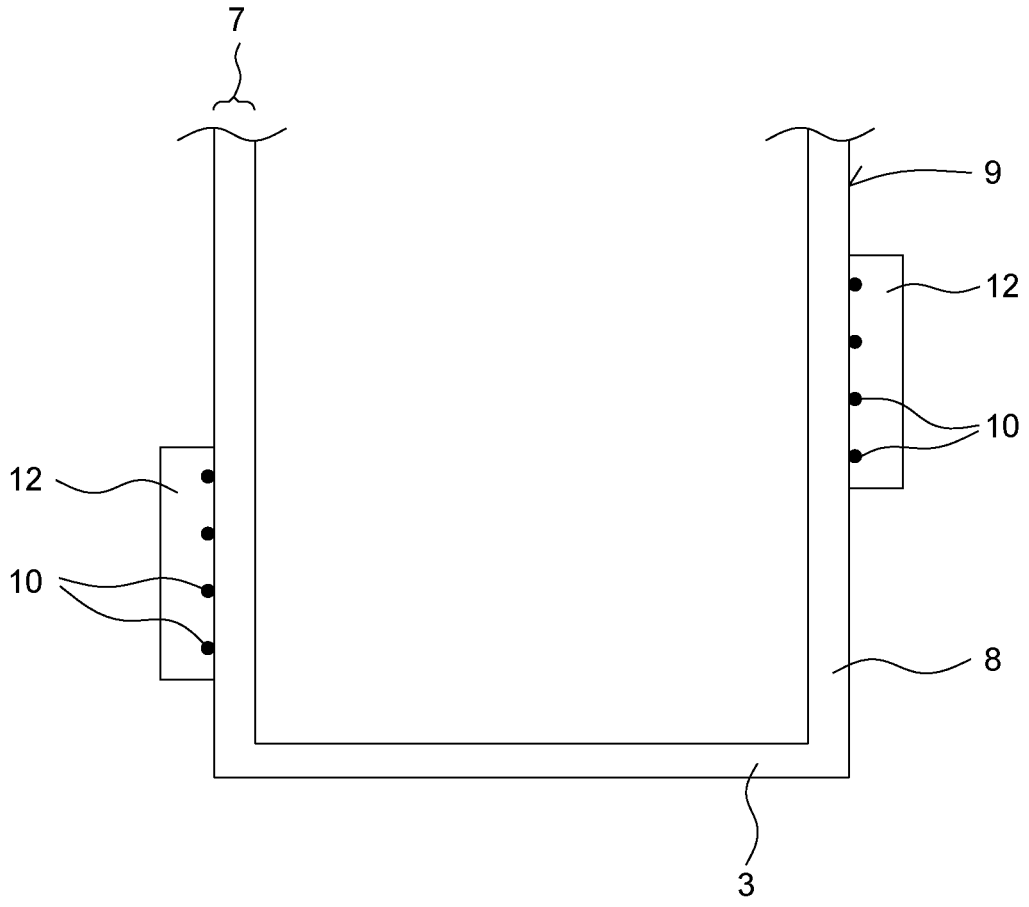
FIG. 3 shows a schematic cross-sectional view of a further embodiment of a galvanizing tank according to the invention.
Figure 4:
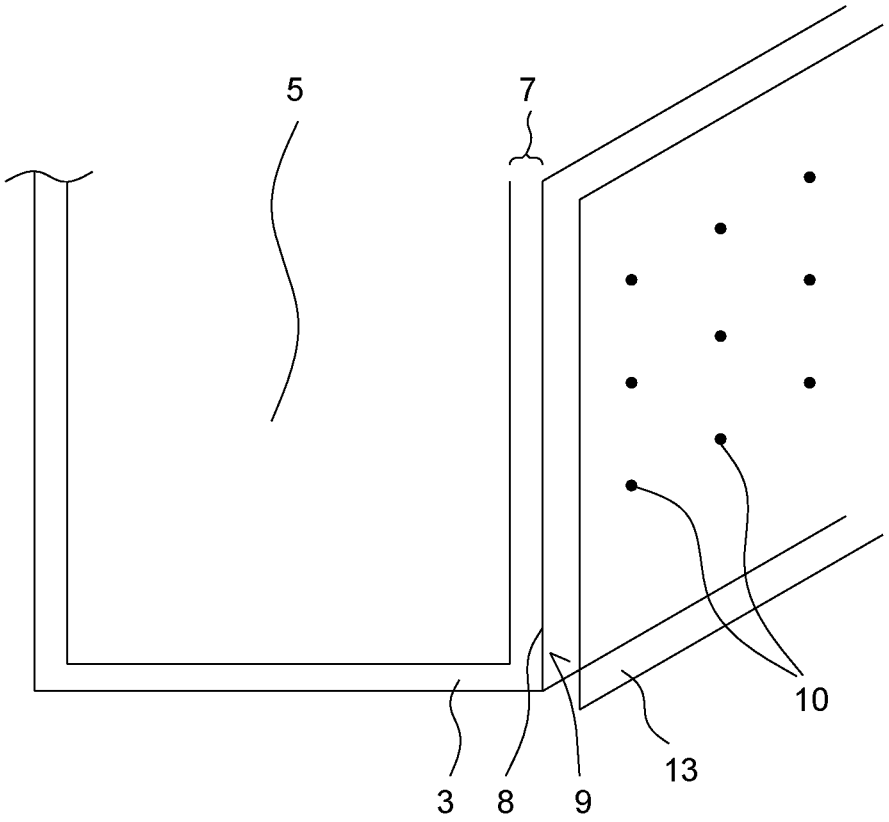
FIG. 4 shows a schematic perspective view of a further embodiment of a galvanizing tank according to the invention.
Figure 5:
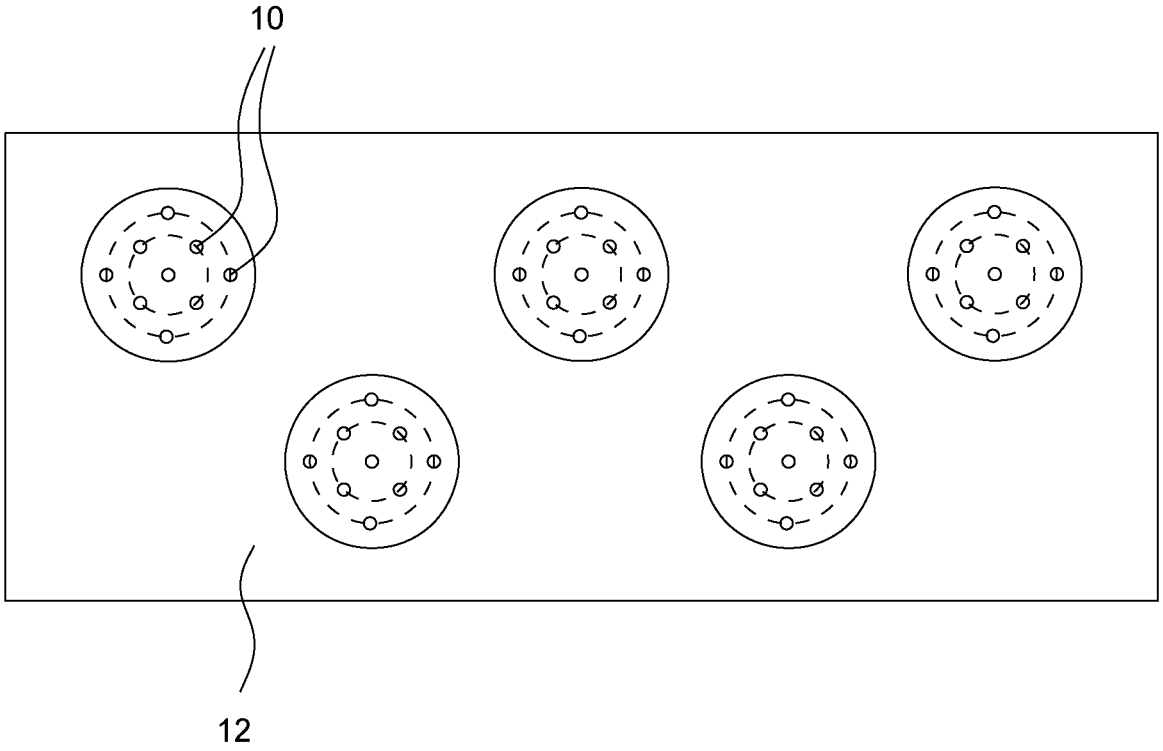
FIG. 5 shows a schematic top view of a carrier plate according to the invention.
Figure 6:
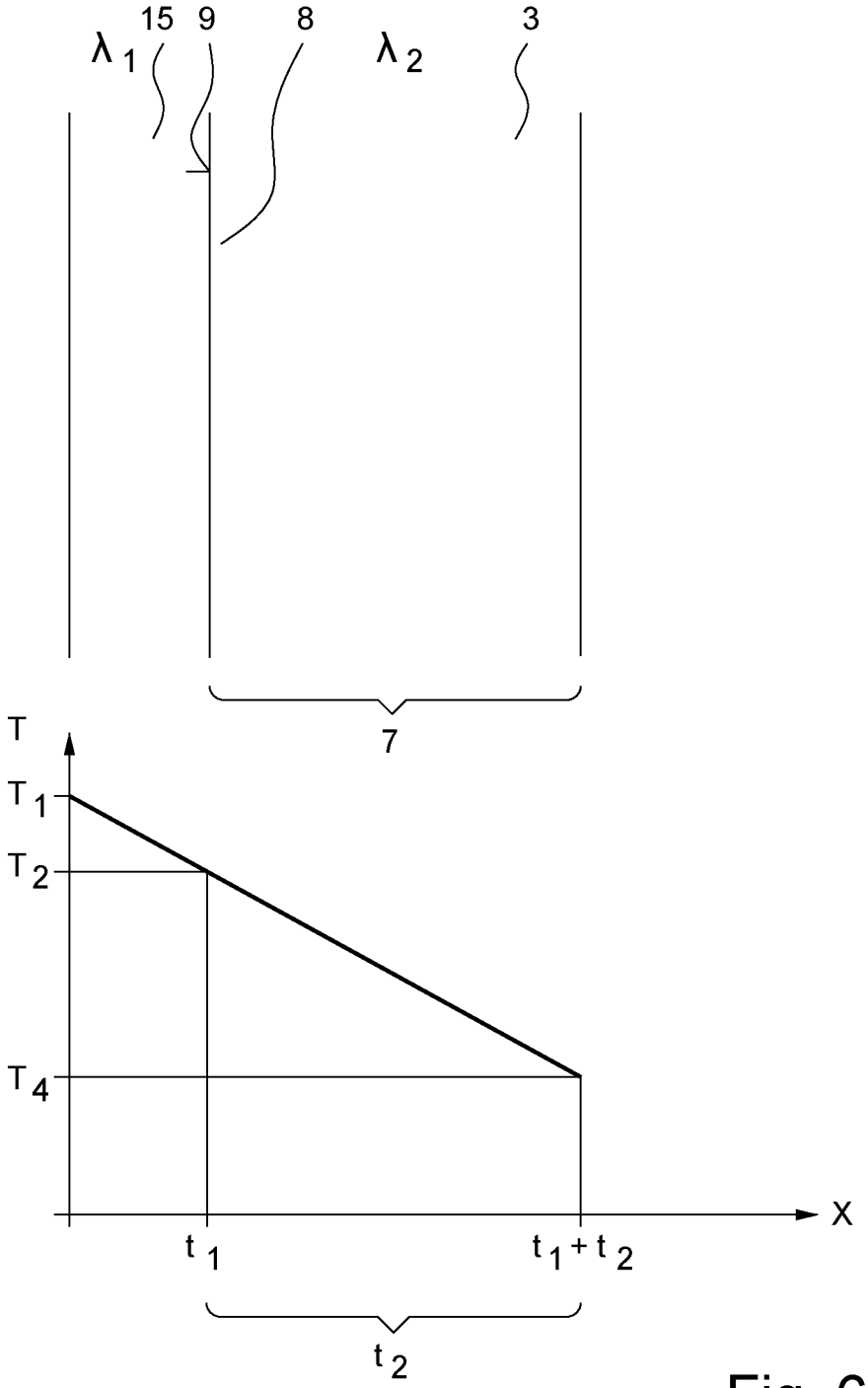
FIG. 6 shows a schematic illustration of the temperature decrease over the wall thickness of a galvanizing tank.
Figure 7:
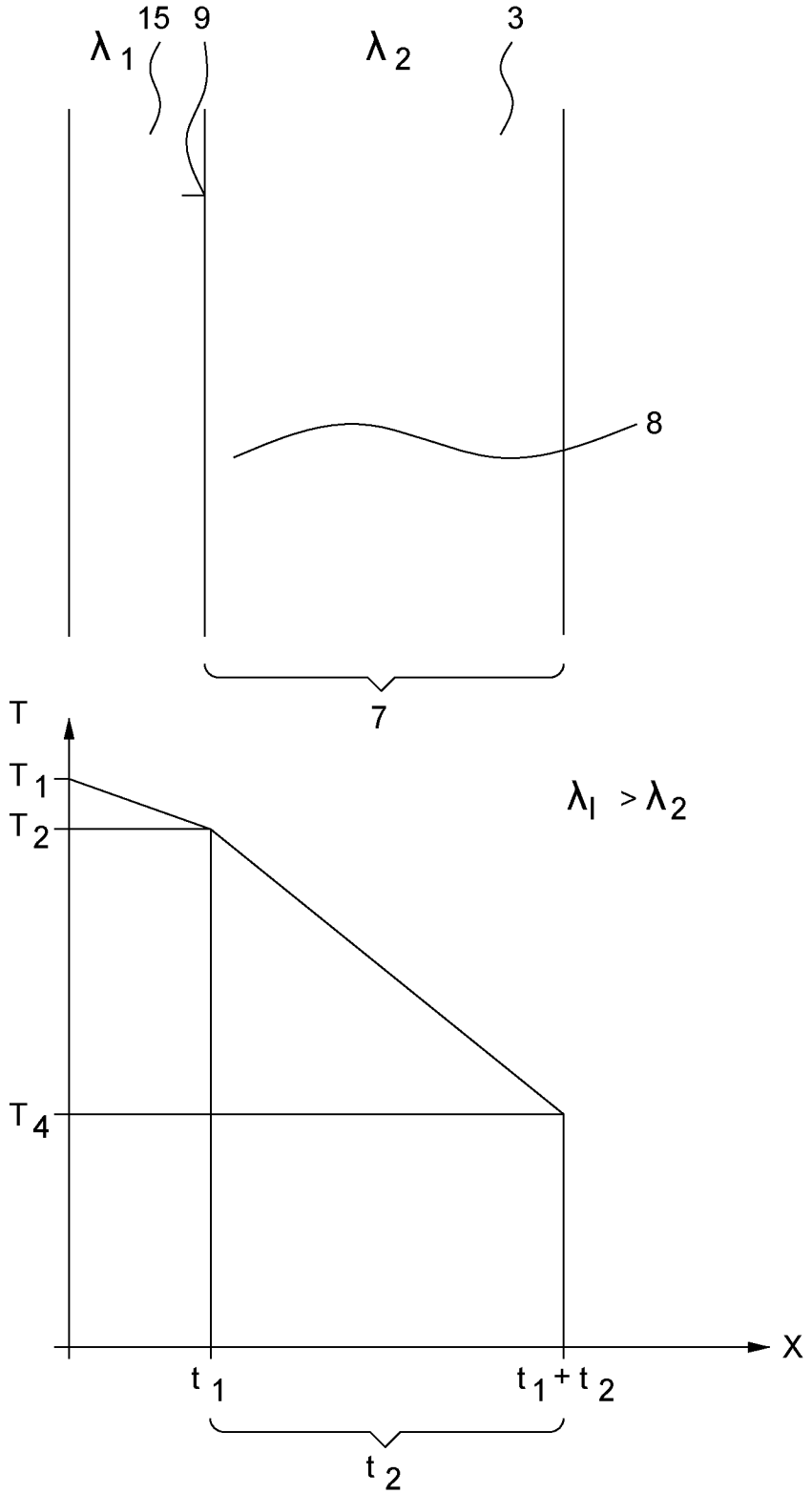
FIG. 7 shows a schematic illustration of the temperature decrease over the wall thickness of a further embodiment of a galvanizing tank.
Figure 8:
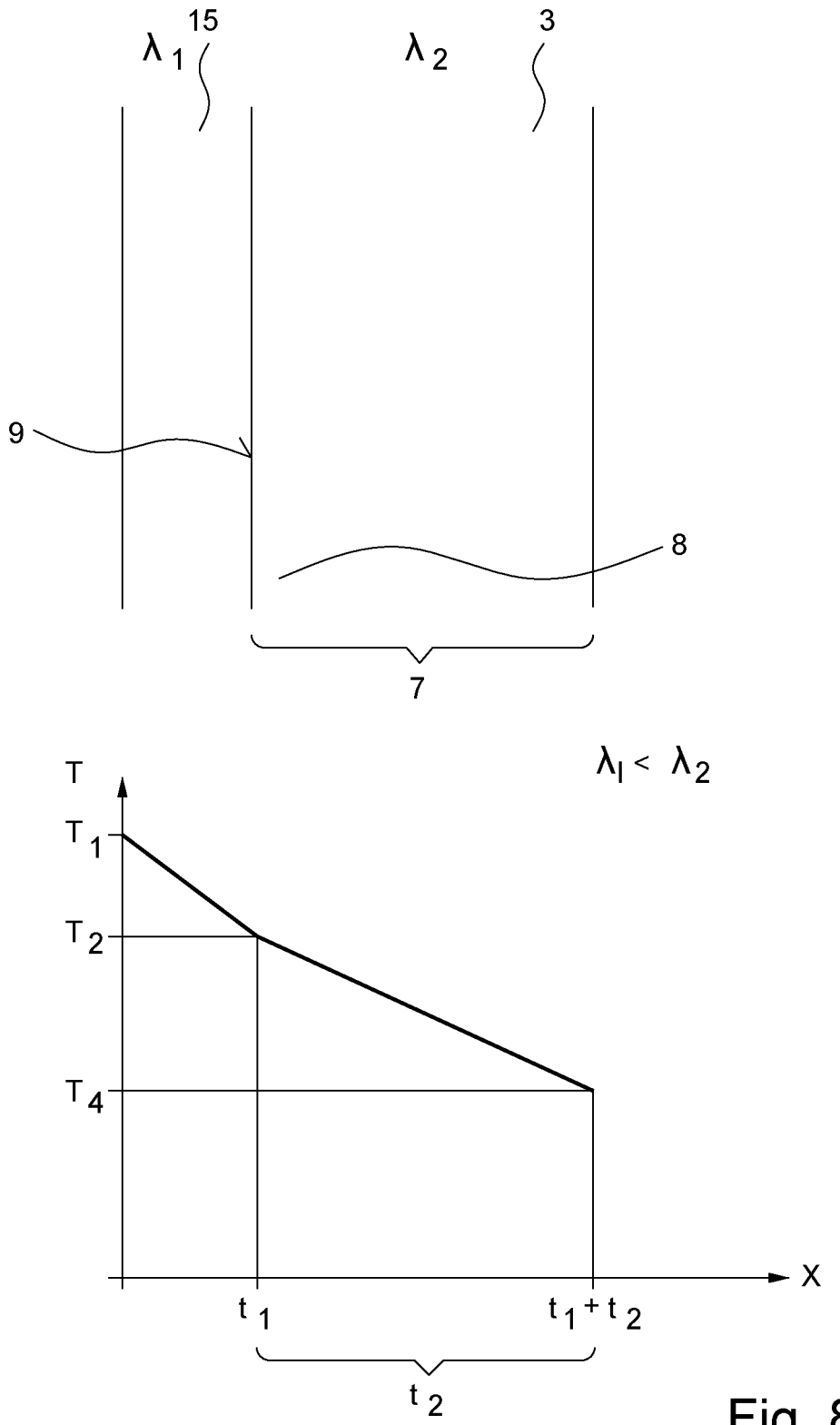
FIG. 8 shows a schematic illustration of the temperature decrease over the wall thickness of a further embodiment of a galvanizing tank.
Figure 9:
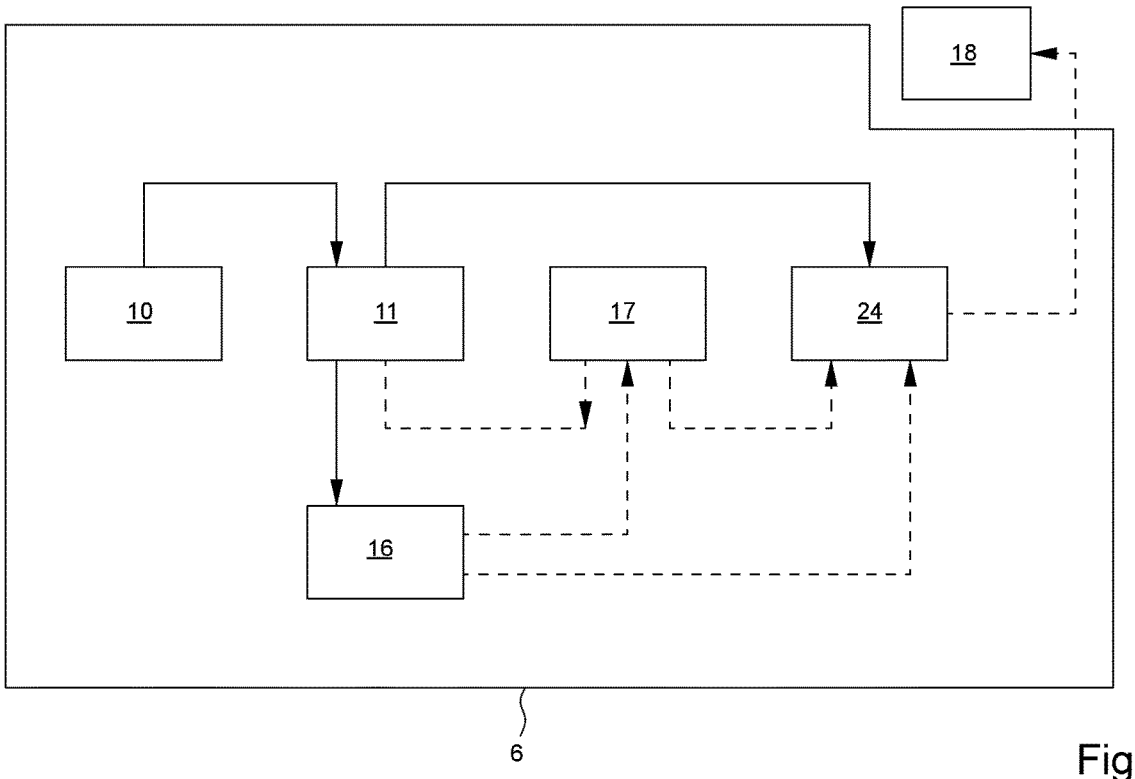
FIG. 9 shows a schematic illustration of the monitoring unit according to the invention.
Figure 10:
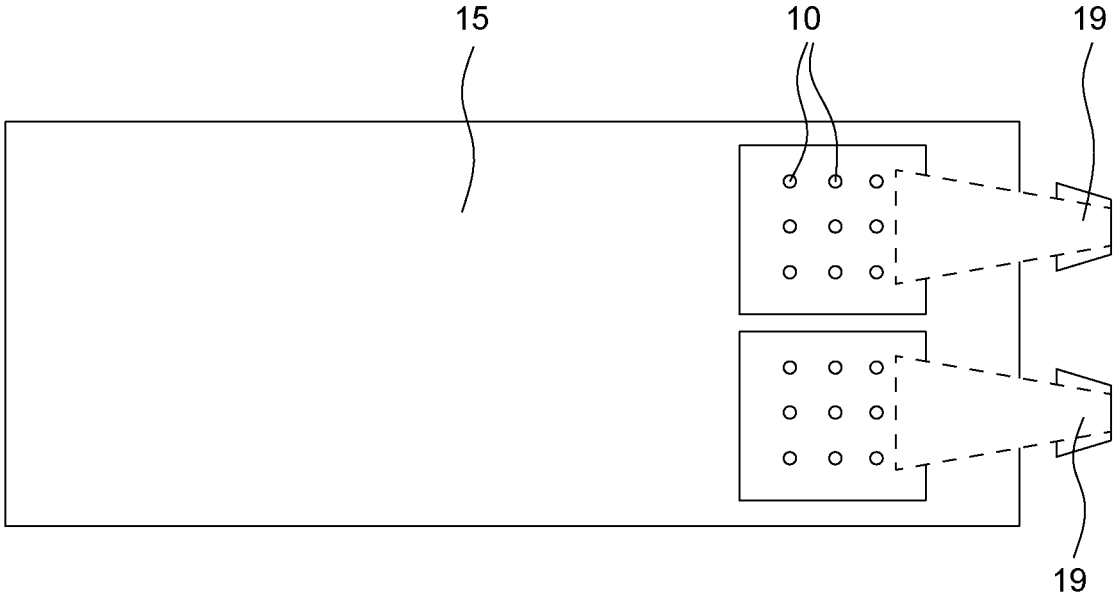
FIG. 10 shows a schematic view of parts of a galvanizing tank using high-speed burners.

In the figures:

FIG. 1 shows a schematic cross-sectional view of a galvanizing tank according to the invention, FIG. 2A shows a schematic cross-sectional view of an alternative of detail A from FIG. 1, FIG. 2B shows a schematic cross-sectional view of another embodiment of detail A from FIG. 1, FIG. 3 shows a schematic cross-sectional view of a further embodiment of a galvanizing tank according to the invention, FIG. 4 shows a schematic perspective view of a further embodiment of a galvanizing tank according to the invention, FIG. 5 shows a schematic top view of a carrier plate according to the invention, FIG. 6 shows a schematic illustration of the temperature decrease over the wall thickness of a galvanizing tank, FIG. 7 shows a schematic illustration of the temperature decrease over the wall thickness of a further embodiment of a galvanizing tank, FIG. 8 shows a schematic illustration of the temperature decrease over the wall thickness of a further embodiment of a galvanizing tank, FIG. 9 shows a schematic illustration of the monitoring unit according to the invention, and FIG. 10 shows a schematic view of parts of a galvanizing tank using high-speed burners.

FIG. 1 shows a device 1 for hot-dip galvanizing of components 2 having a galvanizing tank 3 for accommodating a zinc melt 4 in a tank interior 5 formed by a wall 8 of the galvanizing tank 3. It is provided in the illustrated device 1 for hot-dip galvanizing that a monitoring unit 6—according to FIG. 9—is provided for monitoring the wall thickness 7 of the wall 8 of the galvanizing tank 3 during the galvanizing operation. The components 2 to be galvanized are immersed in this case by means of a product carrier 21, which is movably fastened, for example, via a trolley 22 on a traverse 23, in the zinc melt 4 of the galvanizing tank 3. The galvanizing operation is provided when the components 2 are immersed in the zinc melt 4 and/or when the zinc melt 4 is kept in a molten state.

As is also shown in FIG. 1, the galvanizing tank 3 is enclosed in a support structure of the furnace 25. FIG. 2A illustrates that the monitoring unit 6—according to FIG. 9—comprises at least one sensor 10, which is provided in particular in the region of the outer side 9 of the wall 8 of the galvanizing tank 3, for measuring at least one parameter, in particular the temperature of the galvanizing tank 3. In the illustrated exemplary embodiment according to FIG. 2A, a plurality of sensors 10 is provided on the inner side of the outer tank 15 or according to the alternative corresponding to FIG. 2B, on the outer side 9 of the galvanizing tank 3, respectively. FIGS. 2A and 2B are schematic in this regard, since the intermediate space 14 between the outer tank 15 and the wall 8 of the galvanizing tank 3 is shown wider than is provided in FIG. 1. In fact, the intermediate space 14 is embodied as sufficiently narrow that the intermediate space 14 as such does not actually represent an "intermediate space". The intermediate space 14 was schematically shown to illustrate the region of the boundary surface of the wall 8 of the galvanizing tank 3. A schematic widening of the intermediate space 14 was additionally selected to illustrate the arrangement of the sensor or the sensors 10 according to FIGS. 2A and 2B. The outer tank 15 comprises the galvanizing tank 3 in this case, which means that the outer tank 15 is finally a part of the galvanizing tank 3. Finally it is apparent that in a further exemplary embodiment, a multi-layered structure of the galvanizing tank 3 can be provided. In this case, a separate outer tank 15 is not provided. In this embodiment, the sensors are or the sensor 10 is arranged on the outer side 9 of the wall 8 of the galvanizing tank 3.

FIG. 9 illustrates that the sensor 10 is coupled to an analysis unit 11, wherein the analysis unit 11 is provided for processing the measured value recorded by the sensor 10 and for computing and/or deriving the wall thickness 7 of the wall 8 of the galvanizing tank 3 as a parameter. The sensor 10 transmits the measured value by means of a signal, in particular an electric signal, to the analysis unit 11.

It is not shown that the monitoring unit 6 is designed in such a way that a continuous measured value acquisition is performed. In the present embodiment, a measured value acquisition takes place at regular time intervals, which are between one minute and one hour. It is thus possible, for example, to perform a measured value acquisition every ten minutes. Independently of the frequency of the measured value acquisition, the respective measured values are processed via the analysis unit 11.

Furthermore, it is not shown that further sensors 10 and/or one further sensor are provided for measuring further parameters and/or measured values of the device 1 for hot-dip galvanizing. The further measured values relate, for example, to the burner chamber and/or the tank interior 5 and/or to the zinc melt 4. In particular, the temperature in the burner chamber and/or the temperature of the zinc melt 4 is measured, preferably to determine the wall thickness 7 of the wall 8 of the galvanizing tank 3, jointly with the temperature in the intermediate plane 14 and/or in the region of the boundary surface of the wall 8 of the galvanizing tank 3. In addition, it is not shown that the further sensor 10 is coupled to the analysis unit 11.

An ascertainment of the wall thickness 7 of the wall 8 of the galvanizing tank 3 can be performed by measuring the temperature in the boundary surface of the wall 8 of the galvanizing tank 3, in particular with the aid of the temperatures acquired in a standard manner and/or additionally in the burner chamber and also in the zinc melt 4. In this case, the sensor 10, designed in particular as a temperature sensor, is provided in the region of the boundary surface of the wall 8 of the galvanizing tank 3. This is also illustrated in FIG. 2A and FIG. 2B.

It is illustrated hereafter on the basis of a computation example how the wall thickness 7 of the galvanizing tank 3 can be computed from the temperature.

Firstly, a calibration of the sensor 10 is performed in the boundary region of the wall 8 of the galvanizing tank 3, preferably in the new state of the galvanizing tank 3 and/or during installation of the monitoring device 6, in particular at least with knowledge of a known wall thickness 7. Formula (10) is used:

$$t_2 \cdot (T_1 - T_2) = t_1 \cdot (T_2 - T_4)$$

where $\lambda_1 = \lambda_2$ $T_1$ temperature in the burner chamber, outer side of the carrier plate 12 and/or the outer tank 15 and/or the wall section 13

$T_2$ temperature in the intermediate plane between carrier plate 12 and galvanizing tank 3 (inner side of carrier plate 12/outer side 9 of the galvanizing tank 3)

$T_4$ temperature at the inner wall of the galvanizing tank 3

$t_1$ wall thickness of the carrier plate 12 and/or the outer tank 15 and/or the wall section 13

$t_2$ wall thickness 7 of the wall 8 of the galvanizing tank 3

The following transformation can be made to ascertain the temperature $T_z$:

$$T_2(-t_2 - t_1) = -t_2 T_1 - t_1 \cdot T_4$$

$$T_2 = \frac{t_2 T_1 + t_1 \cdot T_4}{t_1 + t_2}$$

$$t_1 = 20 \text{ mm}$$

$$t_2 = 50 \text{ mm}$$

$$T_1 = 600^\circ \text{ C.}$$

$$T_4 = 450^\circ \text{ C.}$$

$$T_2 = \frac{50 \cdot 600 + 20 \cdot 450}{50 + 20} \frac{\text{mm} \cdot {}^\circ \text{ C.}}{\text{mm}}$$

$$T_2 = 557.14^\circ \text{ C.}$$

In the computation, it is assumed that the temperature distribution in the burner chamber and also in the tank interior 5 and/or in the galvanizing tank 3 is to be considered homogeneous. The theoretical temperature $T_2$ resulting in the boundary surface and/or resulting in the intermediate space 14 is acquired in this case by means of the sensor 10. The calibration can be carried out in the new state via the comparison of the theoretical TARGET value and the actually acquired ACTUAL value.

In the case of a continuous measured value acquisition, for example, a state results after eight years, which is characterized in that wall thickness of the carrier plate 12 and/or the outer tank 15 and/or the wall section 13 $t_1$=20 mm temperature in the burner chamber $T_1$=600° C.

temperature of the inner side of the galvanizing tank 3 $T_4$=450° C.

temperature in the boundary plane or the boundary surface of the wall 8 of the galvanizing tank 3 $T_2$=535° C.

The thickness or the wall thickness 7 of the galvanizing tank 3 may be determined as follows:

$$t_2 = t_1 \cdot \frac{T_2 - T_4}{T_1 - T_2}$$

The following results using the known variables:

$$t_2 = 20 \cdot \frac{535 - 450}{600 - 535} \text{mm}$$

$$t_2 = 26.15 \text{ mm}$$

A significant reduction of the wall thickness 7 of the galvanizing tank 3 is thus provided after eight years from 50 mm to 26 mm. This critical wall thickness 7 of the galvanizing tank 3 can be continuously monitored by the monitoring unit 6 and if it falls below a limiting value, for example, below 25 mm, either a notification signal and/or a countermeasure can be triggered or initiated, respectively.

In addition, it is not shown that the sensor 10 is designed as a thin-film thermocouple and/or as a sheath thermocouple. In particular, the sensor 10 withstands thermal stresses of greater than 650° C.

As already explained, FIG. 2 shows that a plurality of sensors 10 distributed over a region of the outer side 9 of the wall 8 of the galvanizing tank 3 is provided. This plurality of sensors 10 is provided in this case either on the inner side of the outer tank 15 (according to FIG. 2A) and/or on the outer side of the galvanizing tank 3 (according to FIG. 2B). The sensors 10 acquire in this case in particular the temperature in the intermediate space 14 between the outer tank 15 and the galvanizing tank 3, in particular the boundary surface of the wall 8 of the galvanizing tank 3.

The sensors 10 can be attached and/or arranged in various ways on the outer side 9 of the galvanizing tank 3. FIG. 3 schematically shows that the sensor 10, the sensors 10 in FIG. 3, is/are provided on a carrier plate 12. The carrier plate 12 is preferably arranged in this case in the region of a heat introduction zone 20—according to FIG. 1—wherein the heat introduction zone 20 is subjected to an elevated thermal stress. The sensor or the sensors 10 can be attached to the carrier plate 12 in the form of a network (according to FIG. 5) or individually.

FIG. 4 shows that the sensor or the sensors 10 are provided on a wall section 13. According to FIG. 4, in this case the wall section 13 extends over the entire height and over the entire height of the galvanizing tank 3. FIG. 4 is thus schematic, since it does not show the support structure of the furnace 25 and the burner unit 18 and in addition shows the gap between the outer side 9 of the wall 8 of the galvanizing tank 3 and the inner side of the wall section 13 enlarged and also does not associate a thickness with the wall section 13 to illustrate the arrangement of the sensors 10. In further embodiments (not shown), it can be provided that the wall section 13 extends over the entire height and/or length of the galvanizing tank 3. The sensors 10, which are introduced on the carrier plate 12 and/or the wall section 13, terminate flush on the outer side 9 of the wall 8 of the galvanizing tank 3. In addition to the arrangement of the sensors 10 on a wall section 13 and/or on a carrier plate 12, it is also conceivable according to FIGS. 1 and 2 to provide the sensor 10 or the sensors 10 on an outer tank 15 enclosing the galvanizing tank 3. In this case, the sensors 10 are arranged in the intermediate space 14 or the boundary surface of the wall 8—shown in the exploded view of FIGS. 2A and B—preferably on the inner side of the outer tank 15 separate from the galvanizing tank 3.

In addition, FIG. 9 shows the monitoring unit 6. The monitoring unit 6 comprises, in addition to the at least one sensor 10 and the analysis unit 11, a storage unit 16. The storage unit 16 is used to store the measured and/or computed and/or derived values, in particular the wall thickness 7 of the wall 8 of the galvanizing tank 3. In this case, the signal which contains the values is supplied via the analysis unit 11 to the storage unit 16. The analysis unit 11 also receives the measured value of the sensor 10 via a signal. Furthermore, the monitoring unit 6 comprises a display unit 17 for the optical and/or acoustic display. According to FIG. 9, the display unit 17 is coupled to the analysis unit 11. This coupling has the result that, for example, if the wall thickness falls below a predetermined limiting value of the wall thickness 7 of the wall 8 of the galvanizing tank 3, a notification signal is displayed, in particular optically and/or acoustically. The display unit 17 can receive a signal to trigger a notification signal in this case both from the analysis unit 11 and also from the storage unit 16.

Furthermore, FIG. 9 shows that a control unit 24, which is used to control a burner unit 18, is provided in the monitoring unit 6. According to FIG. 1, the burner unit 18 comprises at least one burner 19. In the embodiment shown in FIG. 1, a plurality of burners 19 is provided. The control unit 24 can receive the signals required for the control in this case from the display unit 17 and/or from the storage unit 16—according to FIG. 9.

It is not shown that the control unit 24 is designed to control the gas supply and/or the air supply of the burner 19 of the burner unit 18. The control unit 24 can in particular control the gas supply and/or air supply of the burner 19 of the burner unit 18 in such a way that an optimum heat transfer is provided by the burner unit 18 into the zinc melt 4.

Furthermore, it is not shown that the sensor 10 is arranged in the region of a heat introduction zone 20. According to FIG. 1, a heat introduction zone 20 is provided on the galvanizing tank 3 in the region in which a burner 19 acts on the galvanizing tank 3. In this region—the heat introduction zone 20—the thermal energy is introduced into the zinc melt 4 and/or into the tank interior 5. An elevated thermal stress of the galvanizing tank 3 and/or of its wall 8 results in these regions.

FIG. 5 schematically shows a carrier plate 12, which is arranged on an outer side 9 of the galvanizing tank 3. The arrangement of the sensors 10 according to FIG. 5 is formed in the form of a network structure, in particular in the case of a galvanizing tank 3 using a flat flame burner, preferably in regions of the heat introduction zone 20. Finally, it is apparent that in a further embodiment (not shown), this arrangement of the sensors 10 can also be provided, in particular in the form of a network in regions of the heat introduction zone 20, also on the outer tank 15 and/or on a wall section 13.

Furthermore, according to FIG. 10, the use of high-speed burners as burners 19 of the burner unit 18 can be provided.

It is not shown that the high-speed burners are positioned frontally and fire into the burner chamber parallel to the longitudinal wall of the galvanizing tank 3. Similarly to the arrangement of the sensors 10 in the case of flat flame burners according to FIG. 5, a networked arrangement of the sensors 10 is possible. A planar arrangement of the sensors 10 on the inner side of the outer tank 15 is recommended, as is shown in FIG. 10. In further embodiments (not shown), it can be provided that the planar arrangement of the sensors 10 is provided on a carrier plate 12 and/or on a wall section 13, as is also shown in FIG. 10.

In the computation of the wall thickness 7 of the wall 8 of the galvanizing tank 3, the thermal conductivity $\lambda_1$, also called coefficient of thermal conductivity or heat transfer coefficient, of both the outer tank 15 and/or of the wall section 13 and/or of the carrier plate 12, and also the thermal conductivity $\lambda_2$ of the wall 8 of the galvanizing tank 3 are required. In the above computation example, it is assumed that the heat transfer coefficient $\lambda_1$ of the outer tank 15 and the thermal coefficient $\lambda_2$ of the galvanizing tank 3 can be considered to be equal. This simplifies the computation of the wall thickness 7 of the galvanizing tank 3.

FIG. 6 schematically shows the temperature decrease over the wall thickness x in the case of equal thermal conductivities. As can be seen from FIG. 6, there is a linear relationship between the temperature T and the wall thickness x. If the wall thickness 7 of the outer tank 15 ($t_1$), the temperature $T_1$ in the burner chamber, the temperature $T_2$ at the outer side 9 of the galvanizing tank 3, and the temperature $T_4$ at the point ($t_1$+$t_2$) are known, the wall thickness 7 ($t_2$) of the wall 8 of the galvanizing tank 3 can be determined. The functional relationship between the temperature T and the wall thickness x is, according to FIG. 6:

$$T(x) = T_1 + x\frac{T_2 - T_1}{t_1}$$

If the thermal conductivity $\lambda_1$ of the outer tank 15 is greater than the thermal conductivity $\lambda_2$ of the galvanizing tank 3, a schematic relationship according to FIG. 7 thus results, wherein the temperature T drops more strongly in the region of the wall thickness 7 of the wall 8 of the galvanizing tank 3 than in the region of the outer tank 15. FIG. 8 shows, in contrast, that a schematic relationship results between the temperature T and the wall thickness x, wherein the temperature in the region of the outer tank 15 drops more strongly in comparison to the wall thickness 7 of the galvanizing tank 3, under the assumption that the thermal conductivity $\lambda_1$ of the outer tank 15 is less than the thermal conductivity $\lambda_2$ of the wall 8 of the galvanizing tank 3.

In addition, a method is provided for hot-dip galvanizing of components 2 in a zinc melt 4, wherein the zinc melt 4 is located and/or arranged in a tank interior 5 formed by a wall 8 of a galvanizing tank 3, using a device 1 for hot-dip galvanizing according to FIG. 1. It is not shown that the method for hot-dip galvanizing of components 2 is carried out by means of a device 1 for hot-dip galvanizing having one of the above-mentioned embodiments. It is provided in the method that the wall thickness 7 of the wall 8 of the galvanizing tank 3 is monitored by means of a monitoring unit 6 during the galvanizing operation. FIG. 9 shows the monitoring unit 6, which is used to monitor the wall thickness 7 of the galvanizing tank 3. FIG. 1 shows the galvanizing tank 3 in the galvanizing operation, wherein the zinc melt 4 is kept in a molten state and components 2 are immersed via a product carrier 21 in the zinc melt 4.

According to FIGS. 2A and 2B, at least one sensor 10 is provided in the region of the outer side 9 of the wall 8 of the galvanizing tank 3. A plurality of sensors 10 is provided in this case. In the illustrated exemplary embodiment, the sensor 10 measures the temperature at the wall 8 of the galvanizing tank 3. According to FIG. 9, the sensor 10 transmits, in particular by means of a signal, the measured parameter, in the illustrated exemplary embodiment the temperature, to the analysis unit 11 coupled to the sensor 10. The analysis unit 11 processes the measured value of the sensor 10 in this case and ascertains and/or computes and/or derives the wall thickness 7 of the wall 8 of the galvanizing tank 3.

It is not shown that in a further exemplary embodiment, a continuous measured value acquisition of the parameter is performed to ascertain the wall thickness 7 of the wall 8 of the galvanizing tank 3.

In addition, FIG. 9 shows that a storage unit 16 stores the computed and/or derived values of the analysis unit 11. The storage unit 16 can be coupled in this case to a display unit 17 of the monitoring unit 6. A display unit 17 of the monitoring unit 6 displays an optical and/or acoustic notification signal in this case. It is not shown that the optical and/or acoustic notification signal is displayed if, for example, the wall thickness falls below a predetermined limiting value of the wall thickness 7 of the wall 8 of the galvanizing tank 3, in particular in the case of a limiting value in the range of 15 to 25 mm. The display unit 17 is coupled to the analysis unit 11 for this purpose. Furthermore, it is not shown that a notification signal is also triggered by the storage unit 16, in particular in the event of a time-critical change of the wall thickness 7 of the wall 8 of the galvanizing tank 3.

Furthermore, FIG. 9 shows that the monitoring unit 6 is coupled to a burner unit 18, wherein the burner unit 18 comprises at least one burner 19 according to FIG. 1. The monitoring unit 6 can control the burner unit 18 via a control unit 24 according to FIG. 9. The control unit 24 receives signals in this case either from the display unit 17 and/or from the analysis unit 11 and/or from the storage unit 16.

It is not shown that the control unit 24 and/or the monitoring unit 6 controls the gas supply and/or the air supply of the burner 19 of the burner unit 18.

LIST OF REFERENCE SIGNS

1 device for hot-dip galvanizing
2 components
3 galvanizing tank
4 zinc melt
5 tank interior
6 monitoring unit
7 wall thickness
8 wall
9 outer side of the wall
10 sensor
11 analysis unit
12 carrier plate
13 wall section
14 intermediate space
15 outer tank
16 storage unit
17 display unit
18 burner unit
19 burner
20 heat introduction zone
21 product carrier

22 trolley
23 traverse
24 control unit
25 support structure of the furnace
T temperature
x wall thickness
$\dot{Q}$ thermal power
$T_1$ temperature in the burner chamber
$T_2$ temperature in the intermediate plane between the outer side of the galvanizing tank and the carrier plate and/or the outer tank and/or the wall section
$T_3$ temperature at the outer side of the galvanizing tank
$T_4$ temperature at the inner side of the galvanizing tank
A area through which the thermal power flows
$t_1$ thickness of the carrier plate and/or the outer tank and/or the wall section
$t_2$ thickness of the galvanizing tank
$\lambda_1$ thermal conductivity of the carrier plate
$\lambda_2$ thermal conductivity of the wall of the galvanizing tank

The invention claimed is:

1. A method for hot-dip galvanizing of metal components in a zinc melt, wherein the zinc melt is comprised in a vessel interior formed by a wall of a hot-dip galvanizing vessel, wherein method comprises as step of monitoring, during hot-dip galvanizing operation, a wall thickness of the hot-dip galvanizing vessel by means of a monitoring unit: wherein the method comprises providing a monitoring unit comprising: at least one sensor for measuring, as a measured value, at least a temperature of the hot-dip galvanizing vessel, which sensor is provided or arranged at an outer side of the wall of the hot-dip galvanizing vessel, and at least one analysis unit for processing the measured value recorded by the sensor and for computing and deriving therefrom the wall thickness of the hot-dip galvanizing vessel, which analysis unit is coupled or assigned to the sensor.

2. The method as claimed in claim 1,
wherein the method is performed in a continuous operation.

3. The method as claimed in claim 1,
wherein the method additionally comprises providing at least one further sensor for measuring at least one further measured value of the hot-dip galvanizing device, with the further measured value being related to one of a combustion chamber, the vessel interior and the zinc melt, wherein the further sensor is coupled or assigned to the analysis unit for processing the measured value recorded by the further sensor and for computing and deriving therefrom the wall thickness of the hot-dip galvanizing vessel.

4. The method as claimed in claim 1,
wherein at least one storage unit coupled or assigned to the monitoring unit stores the measured values, which measured values are computed to derive therefrom the wall thickness of the wall of the hot-dip galvanizing vessel.

5. The method as claimed in claim 1,
wherein a display unit coupled or assigned to the monitoring unit displays at least one of an optical and acoustic notification signal, wherein the notification signal is displayed if the wall thickness falls below a predetermined threshold value.

6. The method as claimed in claim 1,
wherein the monitoring unit is coupled or assigned to a burner unit comprising at least one burner, wherein the monitoring unit controls the burner unit.

7. The method as claimed in claim 1,
wherein the monitoring unit controls at least one of a gas supply and an air supply and an alignment of a burner of a burner unit.

8. A hot-dip galvanizing device for a hot-dip galvanization of metal components, wherein the hot-dip galvanizing device comprises a hot-dip galvanizing vessel comprising a zinc melt in a vessel interior, which vessel interior is formed by a wall of the hot-dip galvanizing vessel; wherein the hot-dip galvanizing device further comprises a monitoring unit for monitoring a wall thickness of the hot-dip galvanizing vessel during the hot-dip galvanization operation, wherein the monitoring unit comprises: at least one sensor for measuring, as a measured value, at least a temperature of the hot-dip galvanizing vessel, which sensor is provided or arranged at an outer side of the wall of the hot-dip galvanizing vessel, and at least one analysis unit for processing the measured value recorded by the sensor and for computing and deriving therefrom the wall thickness of the hot-dip galvanizing vessel, which analysis unit is coupled or assigned to the sensor.

9. The hot-dip galvanizing device as claimed in claim 8, wherein the monitoring unit performs a continuous measurement and processing.

10. The hot-dip galvanizing device as claimed in claim 8, wherein the monitoring unit is designed for a continuous operation.

11. The hot-dip galvanizing device as claimed in claim 8, wherein the monitoring unit comprises at least one further sensor for measuring at least one further measured value of the hot-dip galvanizing device, with the further measured value being related to one of a combustion chamber, the vessel interior and the zinc melt.

12. The hot-dip galvanizing device as claimed in claim 11, wherein the further sensor is coupled or assigned to the analysis unit for processing the measured value recorded by the further sensor and for computing and deriving therefrom the wall thickness of the hot-dip galvanizing vessel.

13. The hot-dip galvanizing device as claimed in claim 8, wherein the sensor is designed as a temperature sensor which is provided on the exterior of the hot-dip galvanizing vessel.

14. The hot-dip galvanizing device as claimed in claim 8, wherein the sensor is designed as a thermocouple.

15. The hot-dip galvanizing device as claimed in claim 8, wherein the sensor is designed as a thin-film thermocouple or as a sheath thermocouple.

16. The hot-dip galvanizing device as claimed in claim 8, wherein a plurality of sensors distributed over the outer side of the wall of the hot-dip galvanizing vessel is provided.

17. The hot-dip galvanizing device as claimed in claim 8, wherein the sensor is provided on a support or on a carrier plate.

18. The hot-dip galvanizing device as claimed in claim 8, wherein the sensor is provided on a wall section extending over the entire height or length of the hot-dip galvanizing vessel.

19. The hot-dip galvanizing device as claimed in claim 8, wherein the sensor is provided in an intermediate space formed by an outer vessel enclosing at least partially the exterior of the hot-dip galvanizing vessel.

20. The hot-dip galvanizing device as claimed in claim 8, wherein the monitoring unit comprises at least one storage unit for storing the measured values.

21. The hot-dip galvanizing device as claimed in claim 8, wherein the monitoring unit comprises a display unit for at least one of an optical and acoustic display.

22. The hot-dip galvanizing device as claimed in claim 21, wherein the display unit is coupled to the analysis unit such that a notification signal is displayed if the wall thickness falls below a predetermined threshold value.

23. The hot-dip galvanizing device as claimed in claim 22, wherein the predetermined threshold value of the wall thickness is in the range of from 5 mm to 20 mm.

24. The hot-dip galvanizing device as claimed in claim 8, wherein the monitoring unit is coupled to a burner unit comprising at least one burner, and wherein the monitoring unit is designed to control the burner unit.

25. The hot-dip galvanizing device as claimed in claim 8, wherein the monitoring unit is designed to control at least one of the gas supplies and the air supply of a burner of a burner unit and the alignment of a burner in relation to the hot-dip galvanizing vessel.

26. The hot-dip galvanizing device as claimed in claim 8, wherein the sensor is arranged in a region of a heat introduction zone of a burner unit.

27. A hot-dip galvanizing device for a hot-dip galvanization of metal components, wherein the hot-dip galvanizing device comprises a hot-dip galvanizing vessel comprising a zinc melt in a vessel interior, which vessel interior is formed by a wall of the hot-dip galvanizing vessel; wherein the galvanizing vessel is produced from steel; wherein the hot-dip galvanizing device further comprises a monitoring unit for monitoring a wall thickness of the hot-dip galvanizing vessel during the hot-dip galvanization operation, wherein the monitoring unit comprises: at least one sensor for measuring, as a measured value, at least a temperature of the hot-dip galvanizing vessel, which sensor is provided or arranged at an outer side of the wall of the hot-dip galvanizing vessel, and at least one analysis unit for processing the measured value recorded by the sensor and for computing and deriving therefrom the wall thickness of the hot-dip galvanizing vessel, which analysis unit is coupled or assigned to the sensor.

28. A hot-dip galvanizing device for a hot-dip galvanization of metal components, wherein the hot-dip galvanizing device comprises a hot-dip galvanizing vessel comprising a zinc melt in a vessel interior, which vessel interior is formed by a wall of the hot-dip galvanizing vessel; wherein the galvanizing vessel is produced from steel; wherein the hot-dip galvanizing device further comprises a monitoring unit for monitoring a wall thickness of the hot-dip galvanizing vessel during the hot-dip galvanization operation, wherein the monitoring unit comprises: at least one sensor for measuring, as a measured value, at least a temperature of the hot-dip galvanizing vessel, which sensor is provided or arranged at an outer side of the wall of the hot-dip galvanizing vessel, wherein the sensor is designed as a temperature sensor which is provided on the exterior of the hot-dip galvanizing vessel, and at least one analysis unit for processing the measured value recorded by the sensor and for computing and deriving therefrom the wall thickness of the hot-dip galvanizing vessel, which analysis unit is coupled or assigned to the sensor.

* * * * *